US005352063A

United States Patent [19]

Allen et al.

[11] Patent Number: 5,352,063

[45] Date of Patent: Oct. 4, 1994

[54] POLYMER CONCRETE PAVING MACHINE

[75] Inventors: J. Dewayne Allen, Paragould, Ark.; Ralph C. Luebke, Memphis, Tenn.; Hugh L. Adams, Bassett, Ark.

[73] Assignee: Allen Engineering Corporation, Paragould, Ark.

[21] Appl. No.: 954,747

[22] Filed: Sep. 30, 1992

[51] Int. Cl.[5] ..... E01C 19/12

[52] U.S. Cl. ..... 404/84.1; 404/84.2; 404/102

[58] Field of Search ..... 404/84.05, 84.1, 84.2, 404/84.8, 96, 101, 102, 108, 114, 118

[56] References Cited

U.S. PATENT DOCUMENTS

| | | | |
|---|---|---|---|
| 2,914,994 | 12/1959 | Pollitz | 404/96 |
| 3,210,710 | 10/1965 | Amos | 404/84.2 X |
| 3,559,544 | 2/1971 | Miller | 404/96 |
| 3,585,912 | 6/1971 | Danielsson | 404/84.05 |
| 3,665,820 | 5/1972 | Rasmussen | 404/84.05 |
| 3,877,830 | 4/1975 | James, III | 404/84.1 |
| 4,012,160 | 3/1977 | Parker | 404/84.05 |
| 4,340,351 | 7/1982 | Owens | 404/118 X |
| 4,502,813 | 3/1985 | Hojberg | 404/118 X |
| 4,685,826 | 8/1987 | Allen | 404/114 |
| 4,702,642 | 10/1987 | Musil | 404/96 X |
| 4,934,864 | 6/1990 | Mauldin | 404/84.05 X |
| 5,129,803 | 7/1992 | Nomura et al. | 404/102 X |

OTHER PUBLICATIONS

Barber-Greene Paving Manual, Model SB-41 Rubber Tired Finisher, Barber-Greene Company-Aurora, Illinois, 1969.

*Primary Examiner*—Ramon S. Britts

*Assistant Examiner*—James A. Lisehora

*Attorney, Agent, or Firm*—Stephen D. Carver

[57] ABSTRACT

A self-propelled paver that distributes, consolidates, places and finishes polymer concrete to rapidly resurface roadbeds. A mobile, wheeled chassis mounts an adjustable hopper that receives premixed polymer from a mixer truck that precedes the paver. A finishing assembly secured to the chassis has a distribution assembly for applying concrete transversely across the surface, and a trailing finishing screed that surfaces and densifies the concrete. An active, hydraulic suspension dynamically orients the chassis and the finishing assembly with the roadbed. Individual height adjusting cylinders can be extended or contracted by an automatic grade control that logically senses grade through an external string line. The distribution system comprises an open bottom exposing the surface to be paved, and an open top adapted to receive concrete from a trough extending from the hopper. A bidirectional auger is rotatably disposed within a distribution box for moving concrete upon the surface. The finishing screed comprises a rigid strike off that initially contacts uncompacted concrete laid by the distribution system. An intermediate pan extending between the strike off and a trailing bull float mounts a plurality of vibrators that facilitate concrete densification. The vertically displaceable hopper can be adjusted to an appropriate operative orientation relative to the mixing truck. When tested in place with a nuclear densitometer, resultant concrete density will meet or exceed standards established for all modern paving jobs. Ride quality as measured by a profilograph according to known procedures will meet all established standards.

27 Claims, 15 Drawing Sheets

POLYMER CONCRETE PAVING MACHINE

BACKGROUND OF THE INVENTION

The present invention broadly relates to paving machines for evenly applying and distributing cementitious flowable materials. More particularly, the present machine relates to road surfacing equipment adapted to resurface or overlay existing roadways with polymer concrete materials. Prior art pertinent to the present invention is classified in U.S. Classes 404 and 94.

The placement of concrete for roadways and highways has evolved over the years. Initially concrete roadways were placed much like any other slab, with the use of static forms and hand manipulated finishing tools. Eventually, machines were developed to assist in the distribution of the concrete. Such devices usually employ a set of sliding, edge forms that assist in forming the roadway. These slip form pavers also employ integral troweling or screeding devices to smooth the surface of the concrete. Typically such conventional pavers use concrete of relatively low slump. As will be appreciated by those skilled in the art, low slump concrete is necessary in highway construction. First, the placed concrete can maintain its shape after the forms associated with the slip form paver move out of contact with the plastic concrete. The cured strength of Portland cement concrete used in highway construction is approximately 4,000 PSI. Conversely, in polymer concrete, the strength is approximately 8000–10,000 PSI, and polymer concrete exhibits a high slump.

A typical slip form paver is disclosed by G. W. Maxon, Jr. in U.S. Pat. No. 3,043,201 issued Jul. 10, 1962. As will be noted upon inspection of this patent, the art of the day was concerned with handling low slump concrete. The design was primarily aimed at avoiding segregation of the aggregate, and handling the relatively thick mixture.

Modern technology plays a role in many present day paving operations. U.S. Pat. Nos. 4,854,769 and 4,861,189 both issued to Mitsuo Fukukawa teach a rather complicated system of paving inclined and curved surfaces. The devices disclosed by Fukukawa employ an anchoring vehicle and a paving vehicle. The paving vehicle is connected by cables to the anchor vehicle. The paving vehicle has a laser transmitter and the anchor vehicle has a laser receiver. The relative arrangement of the two vehicles is controlled by microcomputer that operates a boom on the anchor vehicle to control the height and length of the cable connecting the two vehicles. Further, a screed on the paving vehicle is controlled by a microcomputer to shape the surface of the roadway.

Kasler U.S. Pat. No. 4,988,233 issued Jan. 29, 1991, discloses another modern paving machine. The disclosed machine is primarily intended for paving in zero or minimum clearance applications. It employs a conventional tracked vehicle coupled to a pan assembly which distributes and surfaces the concrete. As will be apparent upon inspection of this patent by one skilled in the art, this machine is intended to distribute relatively low slump concrete. It employs the surface of the subgrade or existing roadway to help move the concrete using augers to distribute the concrete to be worked by the finishing elements of the machine. In other words, concrete is dumped in front of the machine. As it pulls over the concrete it spreads and finishes it.

Three U.S. Patents assigned to the same entity as the present invention are U.S. Pat. Nos. 4,249,327; 4,466,757 and 4,798,494 share a common inventor J. Dewayne Allen. U.S. Pat. No. 4,249,327 issued Feb. 10, 1981 discloses a vibratory screed incorporating a fine grader. A vibratory screed employing a spreading device disposed perpendicular to the screed is disclosed in U.S. Pat. No. 4,466,757. U.S. Pat. No. 4,798,494 discloses a floating vibrational screed comprised of a strike off portion and a pan portion.

As in the present invention machine elevation is controlled by a relatively conventional string line system. Such string lines are strung at an elevation relative to the desired elevation of the new roadway. The paving machine has sensors or "wands" that contact the string on either side of the vehicle to provide sensor data to electromechanical components of the machine controlling the relative height of the finishing components of the machine.

The use of polymers in place of cement in concrete mixtures to provide a high strength abrasion resistant surface is well known. The proper placement and curing of polymer pavement is an evolving "hi-tech" solution to the deterioration of our nation's roadways. Polymer concretes are comprised of aggregates, sand, various polyester or polymer resins known to those skilled in the art, and one or more organic hydrocarbons, such as methyl-ethylketone peroxide (MEK-P), that functions as a catalyst. While relatively expensive, polymer concrete exhibits desirable strength-to-volume relationships that make it ideal for resurfacing bridges and bridge approaches. Much experimental use of such polymer concrete in the highway industry has taken place over the last decade. Polymer concrete technology has evolved to the point that it is now being routinely specified for resurfacing jobs where the overall weight of the roadway bed is of prime consideration. Examples include highway structures such as bridges, bridge approaches, causeways and elevated roadways.

Many roadways and interstate highway systems that have weak and deteriorating road surfaces are essentially structurally sound. In many cases, it is only the first few inches of pavement that must be replaced and resurfaced. With conventional concrete or asphalt, it is difficult to bond the outer replacement surface to the underlying bed. If surface repairs are made with conventional materials, pot holes and cracks quickly appear. The latter problem is avoided with polymer paving materials. Proper use of polymer pavement where the underlying structure and bed of the roadway are sound obviates the necessity to replace the entire roadway and completely rebuild the road structure. Polymer concrete is normally applied in a relatively thin overlay ranging in thickness from one quarter inch to one and a half inch. A simple resurfacing with polymer concrete will provide ten to fifteen more years of use for the bridge or elevated roadway.

Moreover, polymer pavement has superior wear characteristics, it is waterproof and has a higher cured strength than Portland cement concrete. Additionally, polymer concrete has a relatively high slump that is well suited to applications such as bridge approaches and exits, where the roadway bed is banked, curved, or inclined. Polymer concrete can be applied to a rough road surface to fill relatively rough contours without entraining the air pockets that would result if conventional concrete were employed. Slump is often as much as six inches. While many problems related to the handling of low slump concrete have been addressed by the prior art (i.e., slip form pavers), new problems arise when dealing with such a high slump material.

First, high slump material cannot be moved about as easily as the low slump concrete addressed in prior art solutions such as the Kasler patent. As mentioned above, Kasler employs a concrete hopper and augur which have no bottom surfaces. In other words, Kasler employs the ground as the bottom of its hopper and auger housings. High slump polymer concrete cannot be piled in front of the auger as can low slump concrete.

Therefore, it is necessary to provide a hopper on the vehicle and a trough or passageway for the polymer concrete to be transported through. Furthermore, to evenly distribute the concrete transversely it is necessary again to use augers to move it. Additionally, the problem with segregation is even greater with high slump concrete than with low slump concrete. Due to the thinness of the mixture it tends to settle out relatively fast. Hence, it is necessary to continually agitate the concrete from the time it is placed in the hopper until it is delivered to the road surface.

As mentioned above, polymer concrete is usually used for resurfacing purposes. Therefore, it is disposed in a relatively thin layer. The surface of an existing concrete roadway is "shot blasted" or stripped away down to expose a bonding surface, sometimes to the upper surface of the rebar itself. Damaged rebar is repaired. A polymer bonding agent is applied to the exposed surface and allowed to cure prior to the pour. As a result, a relatively rough surface of exposed aggregate is left remaining for the polymer concrete to cover.

As will be appreciated by those skilled in the art, the placement of a thin overlay is in many ways more difficult than the placement of a slab of four to eight inches of thickness. Simply stated, the acceptable margin of error when pouring a one inch slab is much smaller than the margin of error when pouring an eight inch slab. Therefore, precise grade control is necessary.

Additionally, modern paving operations must take into account the need for continued use of an existing roadway. Often paving operations must be accomplished in a relatively short time frame at night, between traffic "rush hours." In fact, some states, such as California, require that its highway contractors perform work at night. Polymer concrete helps to accomplish this goal. Within four hours of placement it is ready for traffic. Therefore, resurfacing work can be finished during the night hours, and the repaired roadway can then endure rush hour traffic the very next morning.

Often it is necessary to repave only a single lane of a roadway while immediately adjacent lanes are still in use. Therefore, it is necessary that modern paving equipment be designed for compact, single lane use. The components of the machine need to be relatively narrow in width and adjustable to accommodate varying lane widths and shoulder configurations. Furthermore, the use of narrow components for such a machine facilitates paving adjacent to structures. For example, if the motive means of the paver is narrower than the lateral distribution components, it's related finishing components can place and finish a slab abutting a standing guard rail or retaining wall.

Polymer pavement, due to its nature and the applications for which it is employed, must be compacted to a relative density of ninety-eight to one hundred percent. While its high slump facilitates such compaction it is still necessary that it be properly handled. One means for reaching such compaction is to "squeeze" the mixture upon placement. Additionally, vibration helps to free any trapped air pockets and of course provides a uniform finish. On roadways such a smooth, uniform finish must necessarily be etched to provide traction for vehicles.

It is thus desirous to provide a polymer paver machine that is capable of distributing polymer concrete in varying widths, while maintaining the blend of its constituents. Furthermore, it is desirous to provide a machine that can work fairly quickly to take full advantage of the quick setting nature of the polymer concrete. A rapid rate of placement is required for polymer concrete in order to place, consolidate and finish the surface prior to chemical transformation of the polymers.

It is further desirous that the machine be capable of fine grade control to provide a uniform thickness with a relatively high slump polymer concrete. Finally, it is important to provide a machine that is capable of placing flowable paving materials in a layer that is not necessarily rectangular. In other words, it may be necessary to lay material in a layer that has a trapezoidal cross-section. Ease of use, precise deposition rate, controllable surface finish and rapid rate placement are important aspects of a practical polymer paver. Variable width paving capability, ease of clean up, and minimum maintenance are other desirable features embodied by the herein disclosed equipment.

SUMMARY OF THE INVENTION

Our Polymer Concrete Paving Machine is designed to distribute, consolidate, place and finish polymer concrete to provide a smooth-riding, highway road surface. When tested in place with a nuclear densitometer, resultant concrete density will meet or exceed standards established for all modern paving jobs. Ride quality as measured by a profilograph according to procedures well known to those skilled in the art will meet all established standards.

The difficult nature of polymer concrete handling and placement requires a special processing capability incorporated into the present polymer paver. A rapid rate of placement is required for polymer concrete to place, consolidate and finish the surface before chemical transformation of the polymers. The intended, resultant plane of the completed highway surface is dynamically established through an automatic grade control system that logically senses grade through an external string line. The finished surface is grooved by the paver to provide proper traction. Ease of use, precise deposition rate, controllable surface finish and rapid rate placement are important aspects of the present invention. Variable width paving capability, ease of clean up and minimum maintenance are other desirable features embodied by the herein disclosed equipment.

The paver's string line grade control system is designed to manipulate an associated finishing assembly to control the screed position precisely. The path of the screed and the screed elevation above the original, prepared surface emulates the string line set. A screed suspended from the machine's frame on a set of arms allows the entire paver to move in unison.

The paver comprises a mobile, wheeled chassis comprising an active suspension. The suspension preferably comprises a plurality of hydraulically actuated, telescoping posts that are extended or contracted to align the plane of the chassis with the intended resultant plane of the finished, paved surface. The suspension comprises individual, height adjusting cylinders within each post controlled by an automatic grade control responsive to a string line sensor. As a grade change is sensed along the string line, the appropriate hydraulic suspension cylinder receives a hydraulic command to adjust the paver frame height. During extension or contraction of the suspension cylinders, chassis orientation is aligned generally with the roadway. The chassis transports a diesel power unit and its accessories, a hopper for receiving polymer concrete ultimately to be applied, and a concrete finishing assembly.

The finishing assembly comprises a concrete distribution system that applies concrete transversely across the surface relative to the direction of travel. A finishing screed assembly is operatively disposed adjacent the distribution system for densifying and finishing applied concrete. The screed assembly is suspended from the rear of the paver frame. Hydraulic controls are available to raise and lower the screed and tilt the screed to assume an appropriate pitch and thus provide the proper amount of compaction to the freshly placed polymer concrete.

The distribution system comprises an elongated distribution box having a generally rectangular cross-section that is defined between front and back walls. The box is oriented generally perpendicularly to the axis of the chassis, lying upon the ground. The box has an open bottom exposing the surface to be paved, and an open top adapted to receive concrete from the hopper trough system. Preferably a bidirectional, distribution auger is rotatably disposed within the distribution box for moving concrete upon the surface between the box ends. After concrete is first distributed, as the machine continues to roll along, it will be contacted and densified by the trailing screed assembly.

The finishing screed preferably comprises a rigid, strike off portion that initially contacts uncompacted cement laid by the distribution system. A bull float portion comprises a trailing portion of the screed. An intermediate pan portion extends between the strike off and the bull float. A plurality of vibrators attached to the pan vibrate the screed to aid in finishing and densifying said concrete. The vibrator system preferably comprises a plurality of adjustable cam electric vibrators disposed on an open dorsal surface of the pan to consolidate, compact and densify the polymer concrete. Preferably the screed is disposed with the strike off portion at a higher relative elevation than the bull float portion to establishing a positive pitch that promotes densification and consolidation of the concrete.

Preferably the hopper receives concrete from an external mixer truck that precedes the paver. The vertically displaceable hopper can be adjusted depending upon the situation to assume an appropriate operative orientation relative to the mixing truck. It thus adjusts to reliably capture incoming concrete. An elongated trough extends from the hopper for conducting concrete to the finishing assembly. A rotatable, bidirectional auger within the hopper trough conveys concrete through the machine over the chassis to the finishing mechanism. Concrete is discharged into the open top of the distribution box, for processing by the finishing assembly.

The finishing assembly is supported through a system of hydraulic cylinders, beams and drag links. These elements stabilize the screed in a paving position and are adjustable to accommodate paving heights, cleaning height, rake and tilt. This adjustment is refined with the use of micro-adjustable links used to fine tune the screed blade position for a particular application.

The screed assembly is expandable in length to accommodate wide or narrow pours. Sections of screed assembly may be bolted together. The screed is fitted with a full pan type blade incorporating both a forward cutting edge and bull float comprising the trailing edge. The screed is fitted with a distribution box on either side of the centerline of the paver. Each distribution box spans the length of its section of screed and is fitted with a controllable speed auger that distributes polymer concrete. Thus, the screed blade is always fully charged as the paver progresses to place concrete. A walkway is placed across the rear of the screed to provide access to the finished surface should hand work be required during the paving process.

Our polymer paver embodies several new and special features. These features are necessary for a paving machine intended to process and finish this very difficult paving material. It is self propelled with hydrostatically powered motors disposed at each drive wheel. It employs proportional power steering. It has a diesel power unit fitted with safety shut-down devices that powers a hydrostatic pump for propulsion and two additional hydraulic pumps. The hydraulic pumps power the power steering, four post automatic grade control, screed tilt and lift, a main feed auger with slew control, a hopper lift and a hydraulic cooling radiator. Additionally, the hydraulic pumps power the screed feed augers contained in spreader boxes attached to the front of the screed. The diesel motor also powers a generator set to provide electric power for the screed vibrator system and lights for night operations. The paver is fitted with an air compressor and an air system used to power hand tools such as chisels and chippers used in the cleaning process or to free obstructions that may build up during paving. The paver is designed with closed, smooth structural members for ease of cleaning cured polymer concrete from the surface of the paver. Walkways and guards are quick removal type to ease the cleaning process. When possible, rubber is used as an interface to improve the ease and speed of machine clean up and to prevent build up of concrete during paving.

The rear wheels may be mechanically disengaged for the purpose of towing the paver about the job site. A tow bar may be connected to a pintle hook mounted to the front of the frame. Between the driver's station and power unit a removable floor section can be easily lifted to provide access to the main auger so that its associated assembly can be cleaned. A driver's station containing a driver's seat and appropriate controls to start and stop the engine, steer the paver and control engine speed is situated at the forward section of the paver. Switches to control and gauges to monitor the pavers automatic grade control are housed at the drivers station. The Automatic grade control employs a string line guide system to sense grade. The controls include override toggle switches, automatic position setting and height indicator gauges.

A rear operator's control station contains controls and instruments intended to support the requirements of the paving operator. The controls are: main auger rotation direction and speed, main auger slew, and rotation direction and speed control for the spreader augers. Hydraulic pressure gauges display the systems' hydraulic operating pressures. The electric vibrator power distribution station controls the vibrator system. The vibrators are powered by inverters which convert and filter the generators alternating current voltage to direct current. The rotating vibrators are sealed units, powered by electric motors with adjustable cams. The cam position can be adjusted to vary vibrational force and amplitude to facilitate consolidation of the concrete. Electric vibrators are preferred since they make less noise, resulting in relatively quiet operation of the machine. By varying the speed of the motors the frequency of vibration can be optimized. Ninety-seven to one hundred percent consolidation is typical of the performance of the vibrator system.

In operation, concrete is delivered from a proportional mixer truck to the paver's hopper. The operator advances the charge of concrete through the main auger trough and slews the main auger delivery end right or left to discharge the concrete into the appropriate distribution box. With the charge in the distribution boxes, the operator moves the charge across the face of the screed right or left as necessary. With both boxes filled with concrete, as necessary, the operator turns the vibrators on and commences travel of the paver depositing a layer of polymer concrete upon the prepared surface. The travel speed is adjusted to an acceptable paving speed via hydrostatic speed control, generally five to fifteen feet per minute. As the polymer concrete leaves the rear of the screed a system of tines rake an etched surface into the concrete. This provides a traction surface rather than leaving a smooth, potentially slippery, surface.

Therefore, a primary object of the current invention is to provide a polymer paver that distributes, places, consolidates and finishes pre-mixed polymer concrete to provide a smooth riding highway road surface.

A fundamental object is to provide a polymer paver that quickly places and finishes the concrete in anticipation of rapid chemical hardening of the polymer concrete.

Another primary object is to provide a polymer paver of the character described that automatically senses and establishes a required grade.

Thus a related object is to provide a polymer paver of the character described that automatically adapts itself for use upon road beds of irregular inclination and grade.

A related object of our invention is to provide a polymer paver that will provide increased production and reduce placement cost.

A still further object is to provide a paver of the character described that can be used on flat horizontal surfaces, for repairing floors and the like.

Another object of the present paver is to place a relatively thin overlay slab consolidated to a density of ninety seven to one hundred percent.

A related object of the present invention is to provide a polymer paver that employs a positive pitch, and a vibratory screed to extrude a consolidated pavement overlay.

A further object of the present invention is to provide a polymer paver that will produce a road surface ready for traffic within hours after placement of the concrete.

A related object of the present invention is to provide a polymer paver that rapidly places concrete employing only one traffic lane to avoid interrupting traffic flow in adjacent lanes.

A further related object of the present invention is to provide a variable width polymer paver.

Another primary object of the present invention is to provide a polymer paver exhibiting: ease of use, precise deposition rate, controllable surface finish, rapid rate deposition and rapid rate processing to place, consolidate and finish the surface before chemical transformation of the polymer.

An object of the present invention is to provide a polymer paver with a diesel power unit intended to power various components of the paver and accessories to facilitate paving operations.

A related object of the present invention is to provide a polymer paver that is self propelled by hydrostatically powered motors connected directly to the drive wheels.

A further related object of the present invention is to provide a paver in which the drive wheels may be mechanically disengaged to facilitate towing of the paver about the job site.

A related object of the present invention is to provide a polymer paver employing proportional power steering.

Another object of the present invention is to provide a polymer paver that can be rapidly disassembled and quickly cleaned.

A related object of the present invention is to provide a polymer paver with walk ways and guard rails of a removable type to minimize the cleaning process time.

A related object of the present invention is to provide a polymer paver that, whenever possible, employs rubber or WHMW material as an interface to improve the ease and speed of machine clean up and to prevent build up of concrete during paving operations.

A further related object of the present invention is to provide a polymer paver with a distribution box lined with WHMW material.

A related object of the present invention is to provide a polymer paver requiring minimum maintenance.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
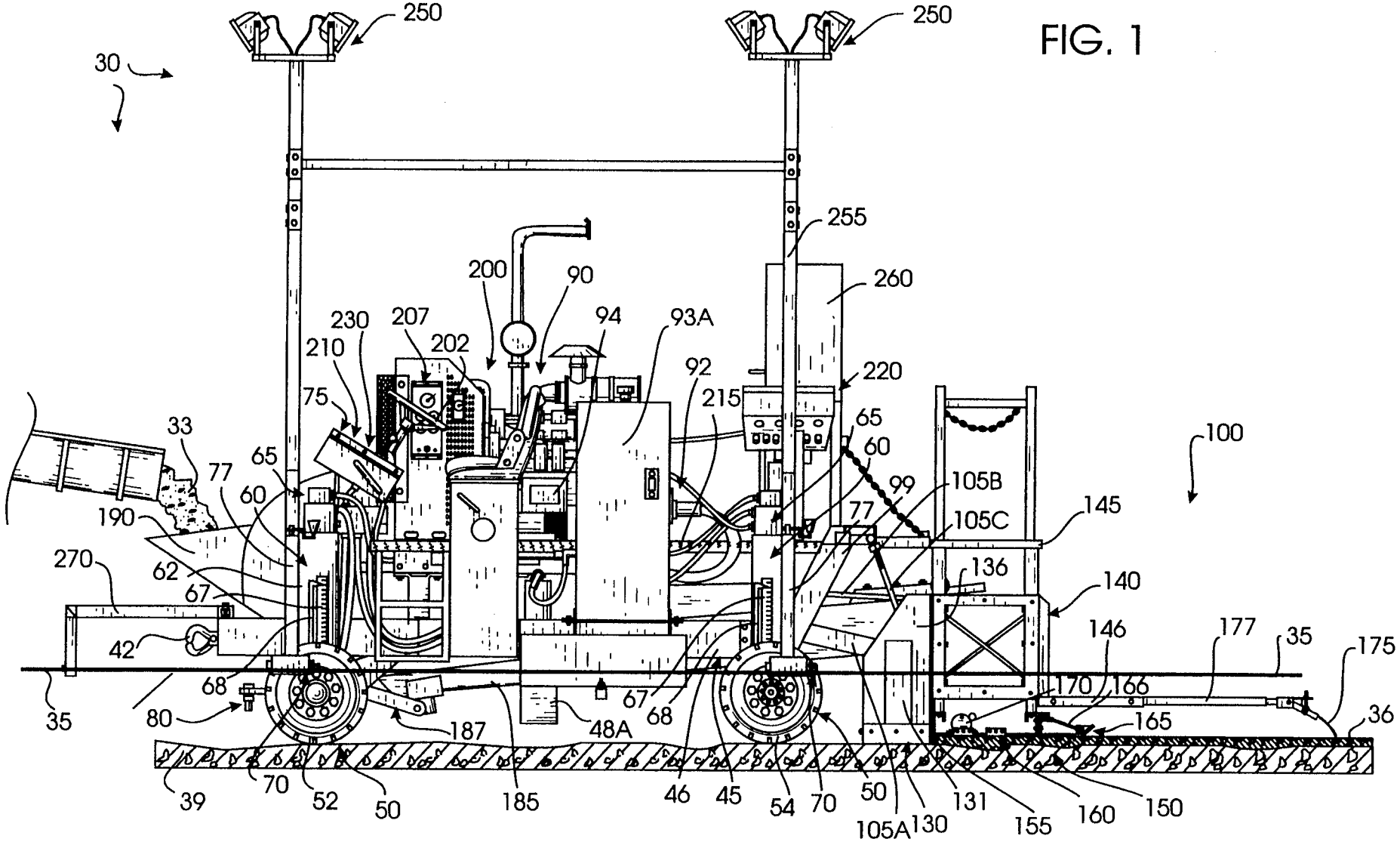
FIG. 1 is a fragmentary, left side, elevational, environmental view of the best mode of our Polymer Concrete Paving Machine illustrating the machine in use, with sections of the hydraulic hoses and electrical cables omitted for brevity and with portions thereof shown in section for clarity.

With reference now to the accompanying drawings, our new Polymer Paver is broadly designated by the reference numeral 30. The preferably self-propelled machine is designed to move along a road bed to be paved with polymer concrete, while sensing grade and inclination. A wheeled chassis 40 (FIG. 6) mounts operative parts. Concrete is inputted at the front 41 (FIG. 5) of the chassis from a conventional mixer truck (not shown) that leads the machine. An internal auger assembly conveys plastic polymer concrete 33 from the front 41 of the chassis 40 to a rear-mounted finishing assembly 100 that distributes polymer and surfaces and finishes the polymer overlay 36.

With reference to FIGS. 5–8, chassis 40 comprises a frame 45 (FIG. 6) suspended upon a set of solid rubber tired wheels 50. An active suspension 57 comprises a set of vertically adjustable posts 60 disposed at corners of the frame. Frame 45 is generally rectangular, narrowing toward its front 45A. The side rails 46 of the frame 45 establish a plane 47. The center area 48 of the frame 45 is disposed lower than the rails. In other words, internal cross members 48A of the frame 45 are "bellied" to accommodate a main auger assembly 180 (FIG. 5) that longitudinally traverses the chassis to convey polymer between the front and back of the machine.

Each dynamically extensible suspension post 60 comprises a pair of extensible sleeves 62 and 64 that are coaxially telescoped together (FIGS. 7, 8) The larger, uppermost sleeve 62 is rigidly fixed to the chassis frame rail 46. A smaller, internal 64 sleeve is affixed to a spindle and backing plate unit 56 mounting a front wheel 52 or a pair of rear dual wheels 54. A hydraulic cylinder 66 extends interiorly from the upper extent of the uppermost sleeve 62 to the lower extent of the internal sleeve 64.

Extension or contraction of the various hydraulic cylinders 66 comprising the active suspension 57 ultimately control the relative orientation of the frame 45 and the finishing assembly 100. The active suspension is activated by a grade control system, to be discussed hereinafter, that is responsive to a string line 35. When the string line 35 is installed on opposite sides of the road bed, it establishes an intended resultant plane of the overlay 36 to be created. Each suspension post 60 mounts a control wand 70 which senses the string line 35 predisposed at an elevation reflective of the grade desired for the finished surface of the polymer concrete overlay 36. These control wands 70 communicate displacement to an electromechanical assembly 75 (FIGS. 1–3), housed at the drivers station 200, which controls the extension and retraction of the posts 60.

Figure 7:
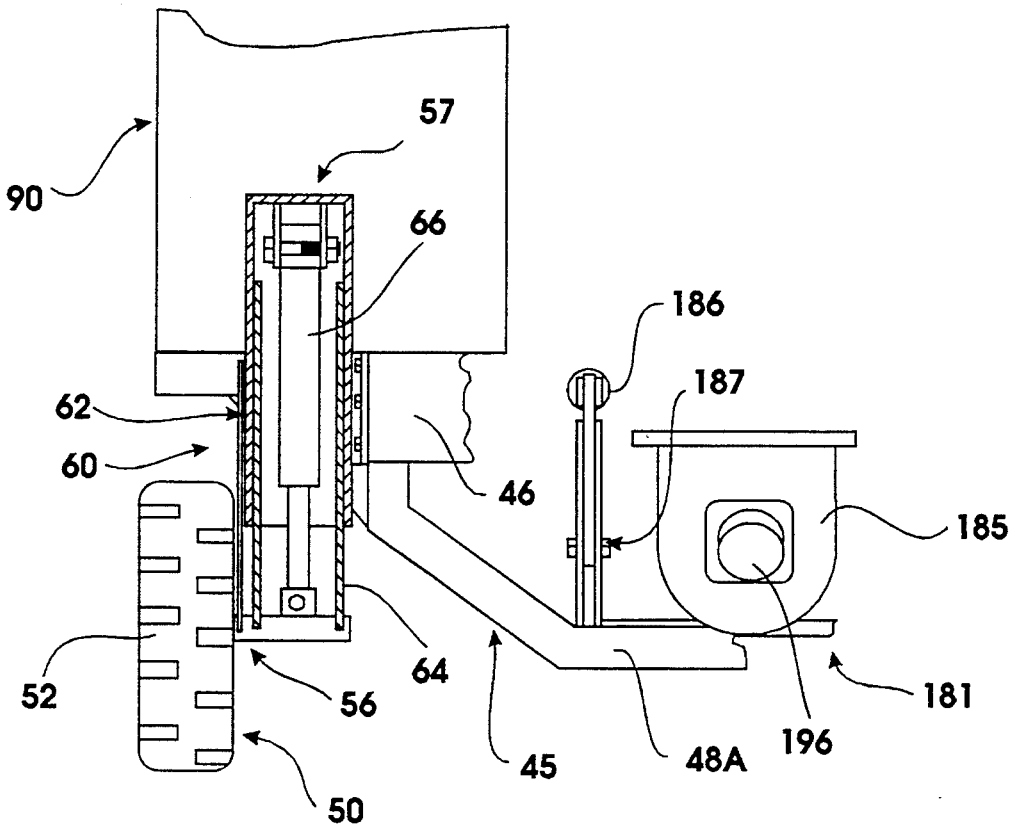
FIG. 7 is a fragmentary, front plan view of the preferred frame and suspension, taken for a position generally to the right of FIG. 2, with portions thereof omitted for clarity.
Figure 8:
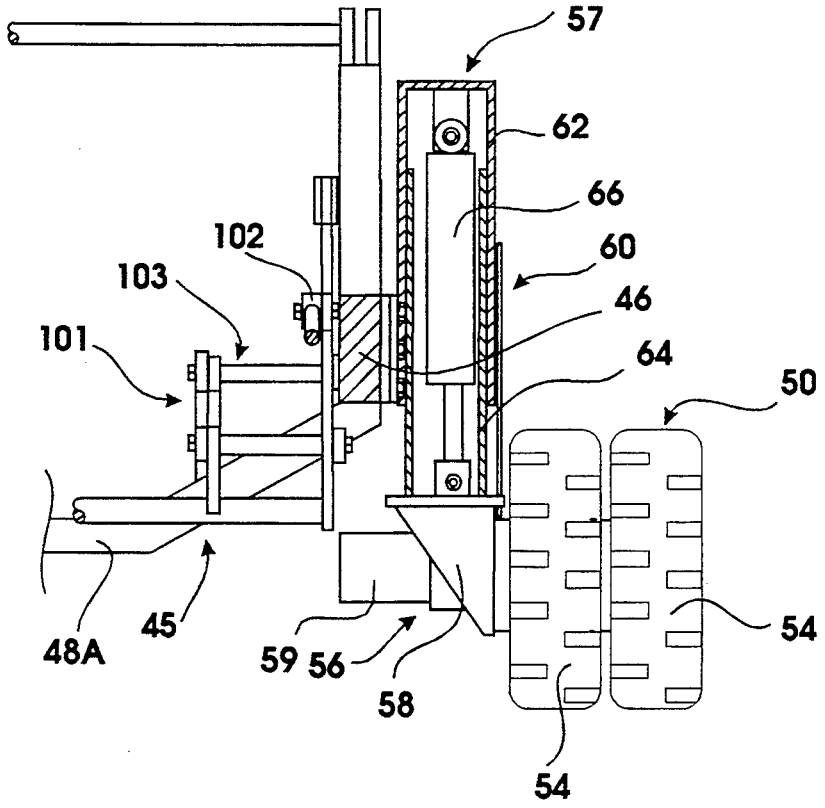
FIG. 8 is a fragmentary, sectional view taken generally along line 8—8 of FIG. 5.

As mentioned above the wheels 50 are mounted on spindles and backing plates 56 (FIGS. 7 and 8). Each of the front wheels 52 are pivotally mounted to the base of the smaller sleeve of a post 60 to establish a steering system 80. The rear wheels are preferably duals 54. Each set of duals 54 is mounted to a fixed, hollow spindle projecting from a backing plate 58. A hydrostatic motor 59 is mounted to each plate. The motor 59 has a splined output shaft which passes through the backing plate 58 and the hollow spindle to engage the wheels. The motors 59 can be disengaged to facilitate towing the paver 30 by a pintle hook 42 secured to the front cross member 49 of the frame 45.

Figure 4:
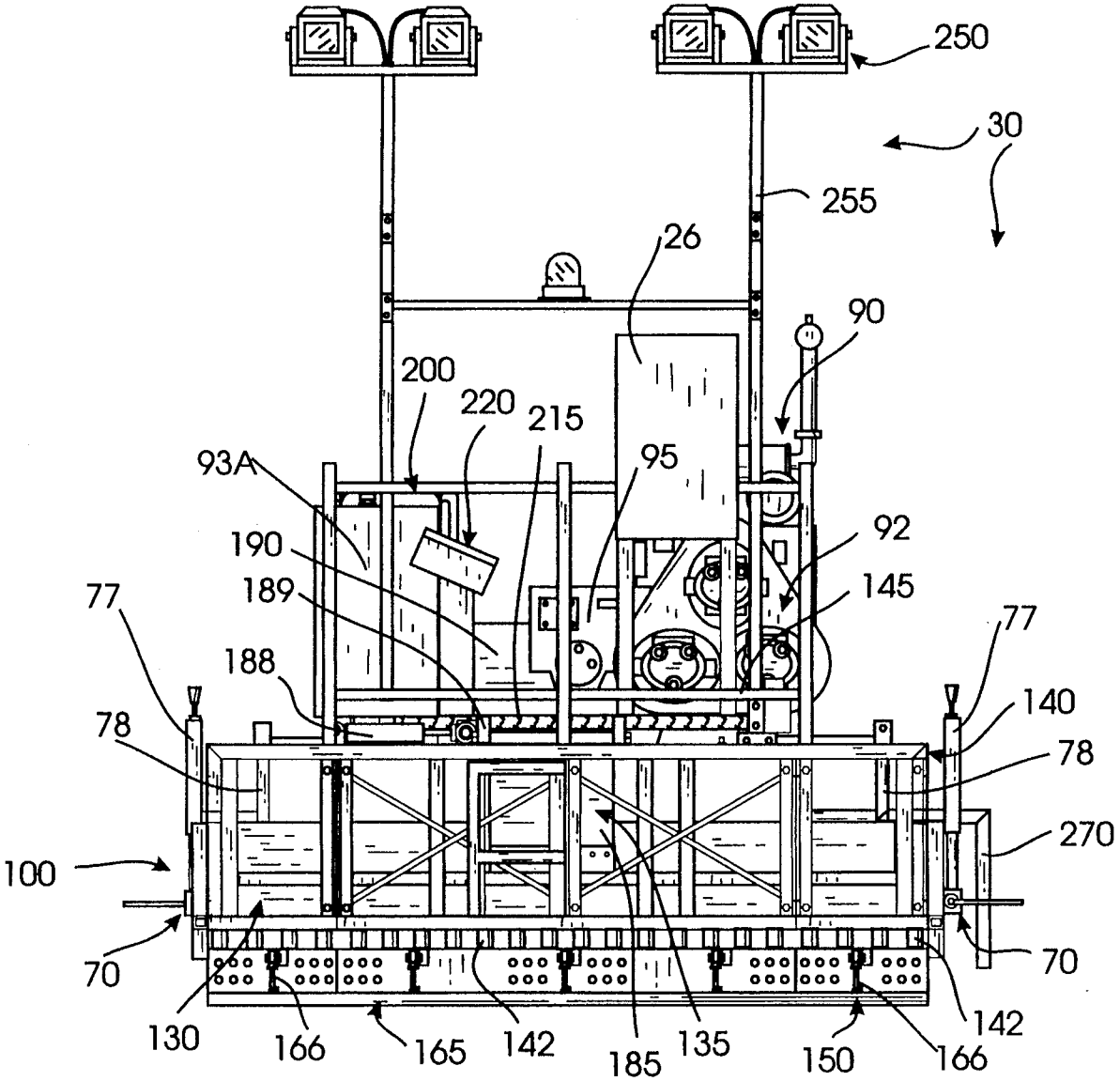
FIG. 4 is a fragmentary, rear elevational view of the paver, with portions thereof broken away or shown in section for clarity.

A diesel engine 90 (FIG. 4) and associated accessories are also secured to the frame 45. The engine drives hydraulic pumps 92, electrical generators 94 and 95, and an air compressor. These elements power various subassemblies as detailed below.

Figure 6:
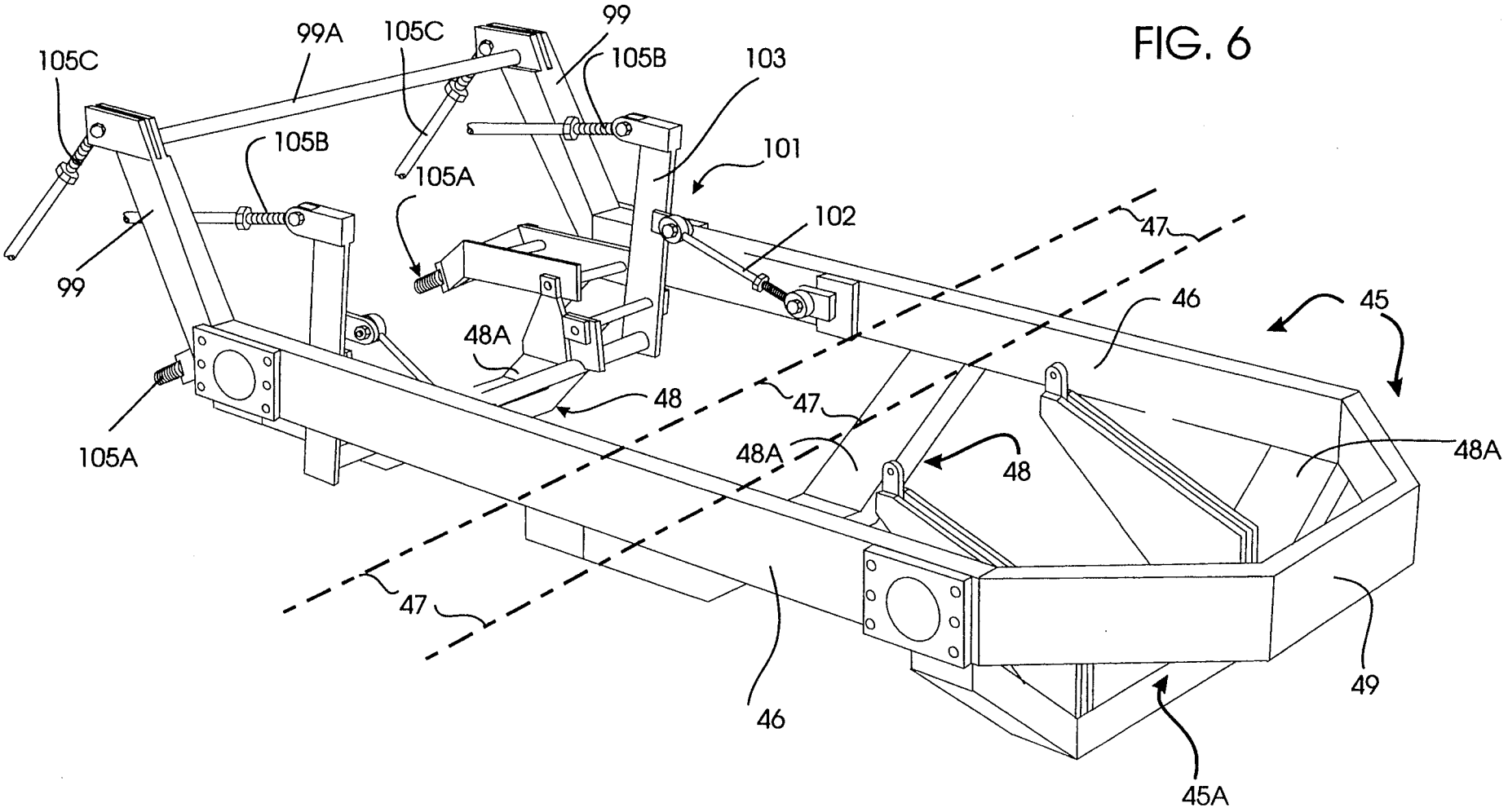
FIG. 6 is an enlarged, fragmentary, partially exploded right front perspective view of the preferred chassis and frame, with portions thereof omitted for brevity.
Figure 11:
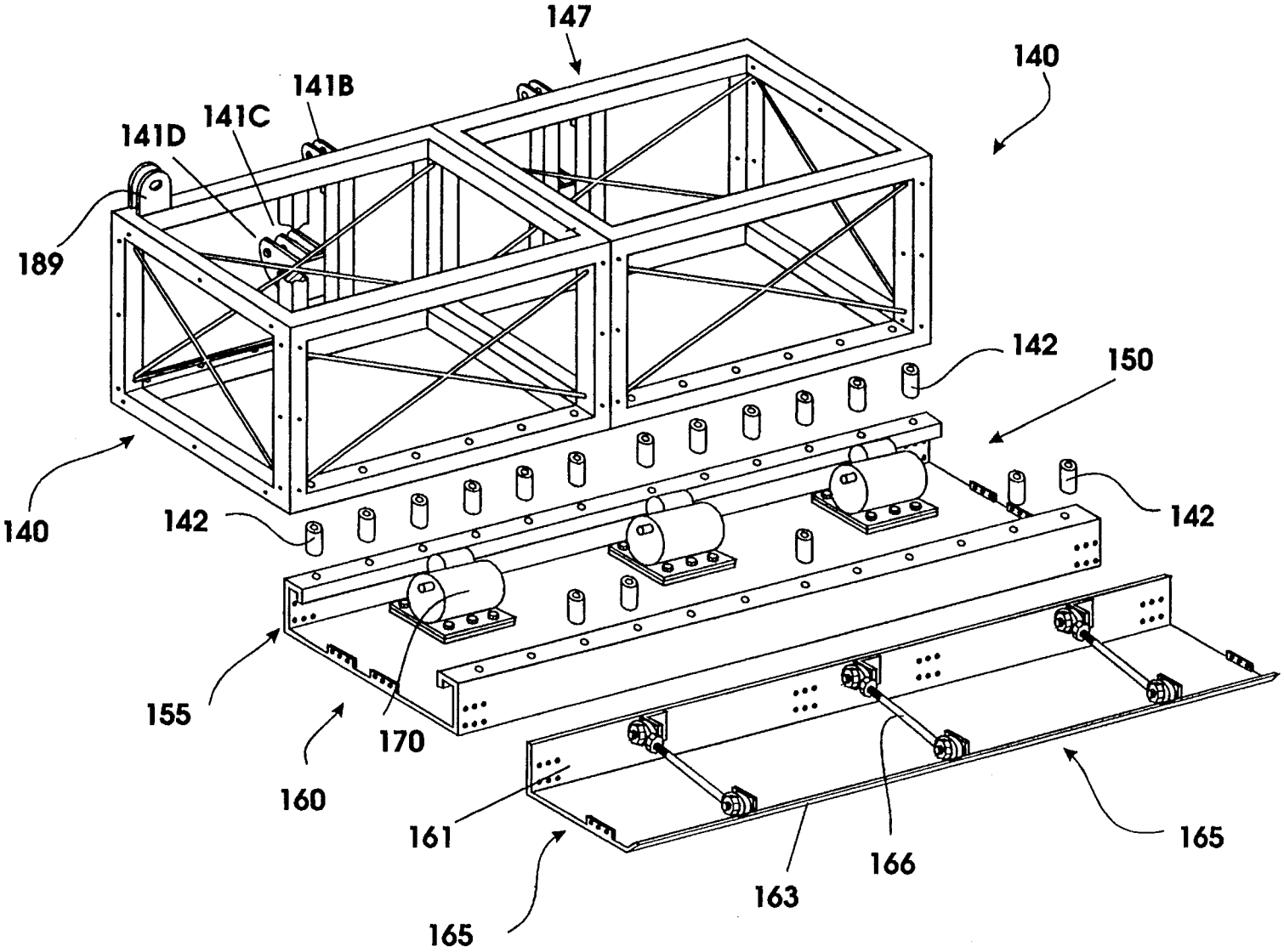
FIG. 11 is an enlarged, fragmentary, left rear isometric view of the central portion of the preferred screed assembly and reinforcing grid.
Figure 12:
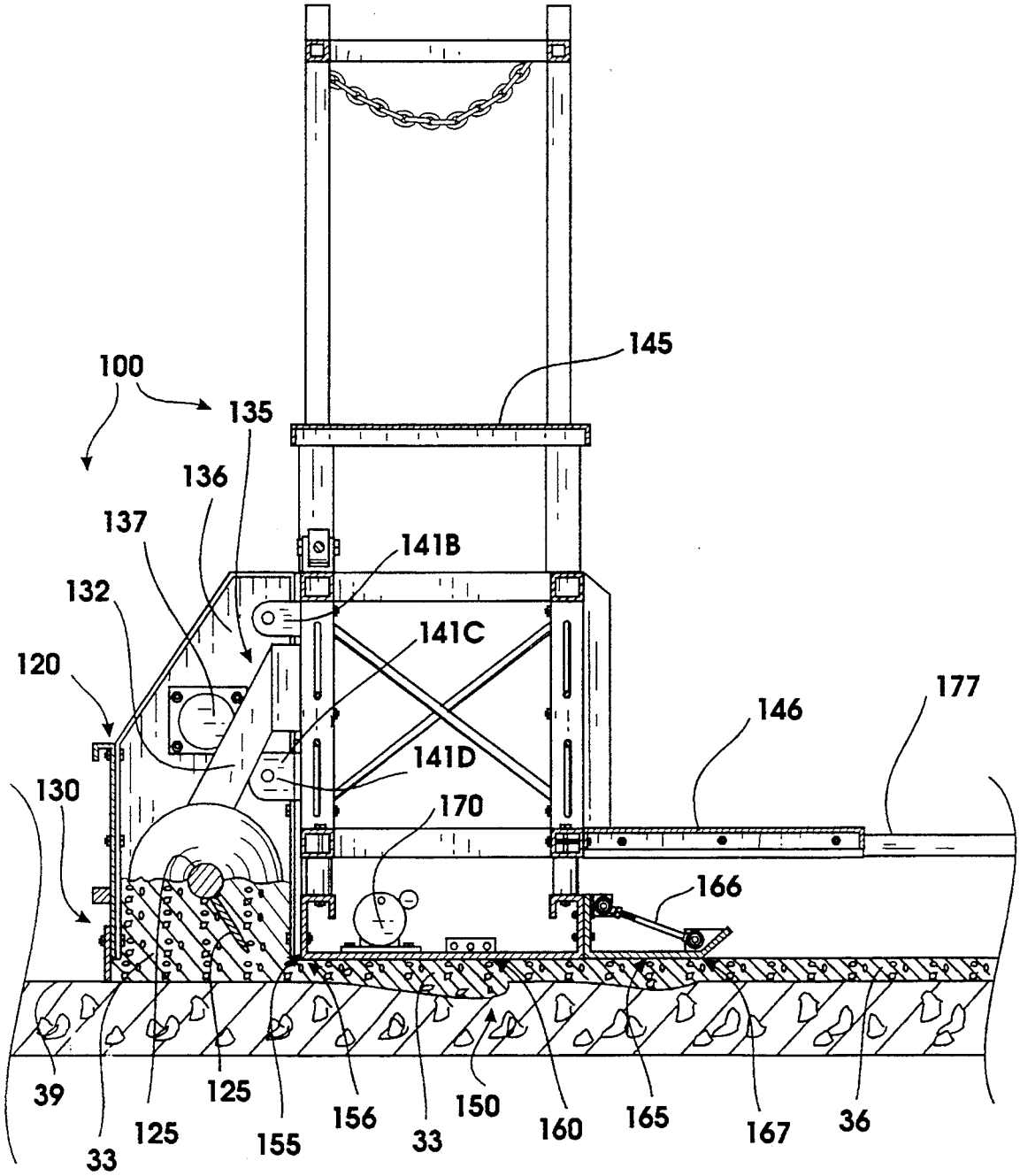
FIG. 12 is a fragmentary, sectional view taken generally along line 12—12 of FIG. 5 with portions thereof broken away for clarity or omitted for brevity.

Finishing assembly 100 is secured to the aft portion of the chassis 40. It is connected by a lift assembly 101 (FIG. 6). Assembly 101 is braced by a micro-adjustable drag link 102. Adjustable links 105A and 105B project from assembly 101 (FIG. 6) for connection to reinforcement truss 140 (FIG. 11). Link 105A connects to brackets 141D ( FIG. 11); links 105B connect to brackets 141B. Links 105C emanating from legs 99 connect to brackets 141C (FIG. 11).

The finishing assembly 100 comprises a distribution system 120 and a finishing screed assembly 150. The distribution system 120 comprises hydraulically rotated distribution augers 125 housed within elongated distribution boxes 130 (FIGS. 9–12). Boxes 130 receive the polymer output of the main auger assembly 180 and confine it in such a manner that the distribution augers 125 can evenly spread it laterally.

The lift assembly 101 (FIG. 6) adjusts the finishing assembly 100 relative to the chassis 40. It is comprised of drag links 102 secured to the frame rails 46 which actuate a rigid linkage formed of spaced apart parallel, bars 103 pivotally connected to the frame rails 46 and pivotally connected to the distribution boxes 130 by manually adjustable links 105A. Links 105B projecting rearwardly from the top of bars 103 extend to the top of the finishing assembly (FIG. 3), and terminate in brackets 141B (FIG. 11). Links 105C (FIG. 6) extend rearwardly from frame support legs 99 to the inner midsection of the finishing assembly (FIG. 3), terminating in brackets 141C (FIG. 11). Strut 99A (FIG. 6) reinforces legs 99. The aforementioned manually adjustable links 105A also terminate at bracket 141C.

The finishing assembly employs the distribution system 120 to apply polymer. With primary reference directed to FIGS. 9 and 12, the distribution boxes 130 are generally rectangular without tops or bottoms. They are oriented transversely across the direction of machine travel. The top is open to receive plastic polymer concrete 33 from the main auger assembly 180 and to allow the operator an opportunity to see that the concrete 33 is being properly distributed. The bottom is open to expose the prepared road surface 39 for concrete application; concrete is applied directly in front of the trailing screed assembly 150. The box receives an internal bracket 132 that mounts the two independently controlled bidirectional variable speed augers 125. An input region 135 is generally defined in the area of the center bracket 132. The augers 125 are journalled for rotational mounting. Bearings within housings 133 are affixed to the ends 136 of the distribution boxes 130 and the center bracket 132. A small hydraulic motor 137 mounted on the end 136 of each box 132 is connected to the auger 125 by a chain 138 and sprocket 139 system, concealed behind panel 131.

Figure 9:
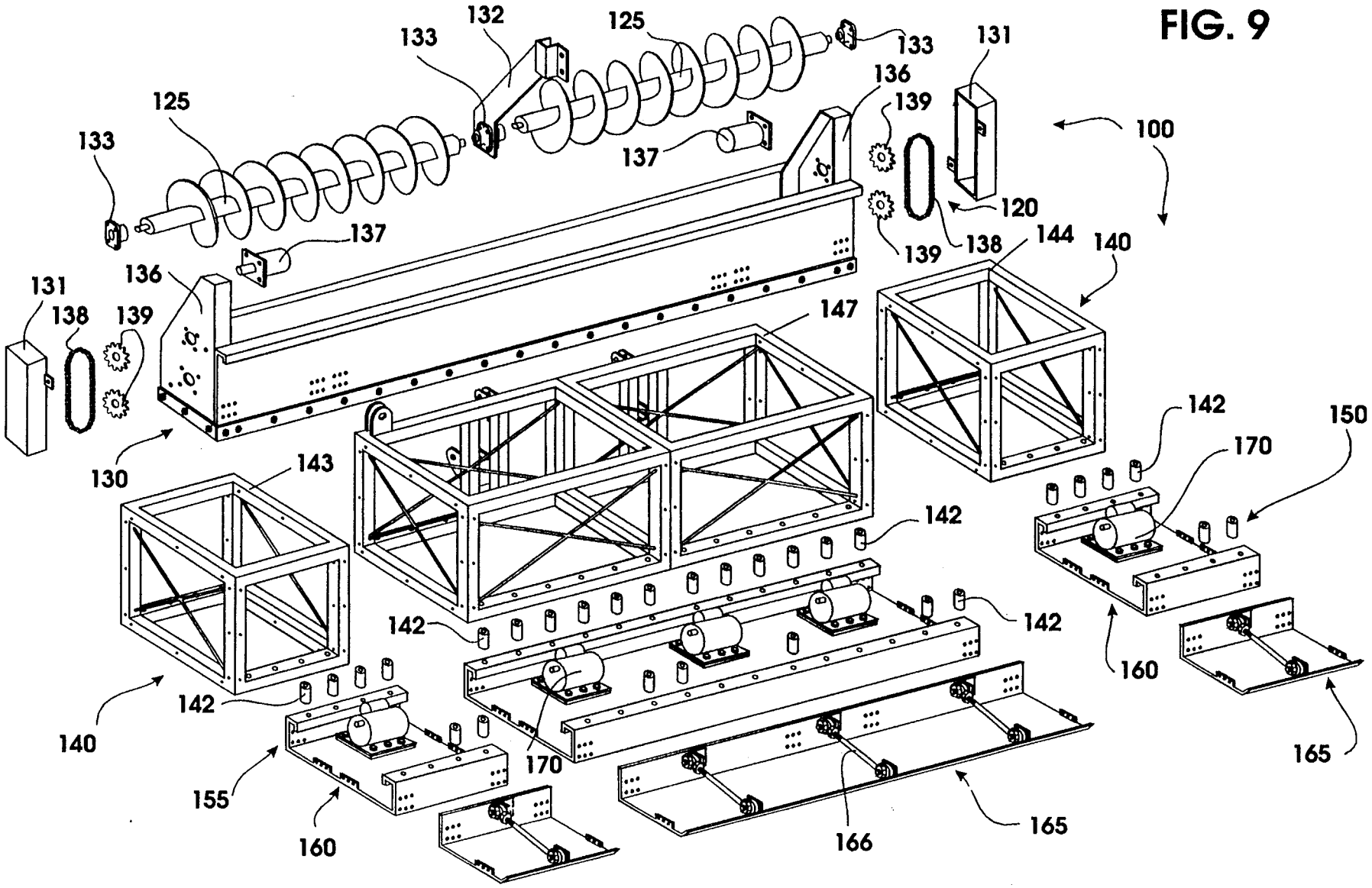
FIG. 9 is an exploded fragmentary, left rear isometric view of the preferred finishing assembly with walkways and some vibration dampening grommets omitted for clarity.
Figure 10:
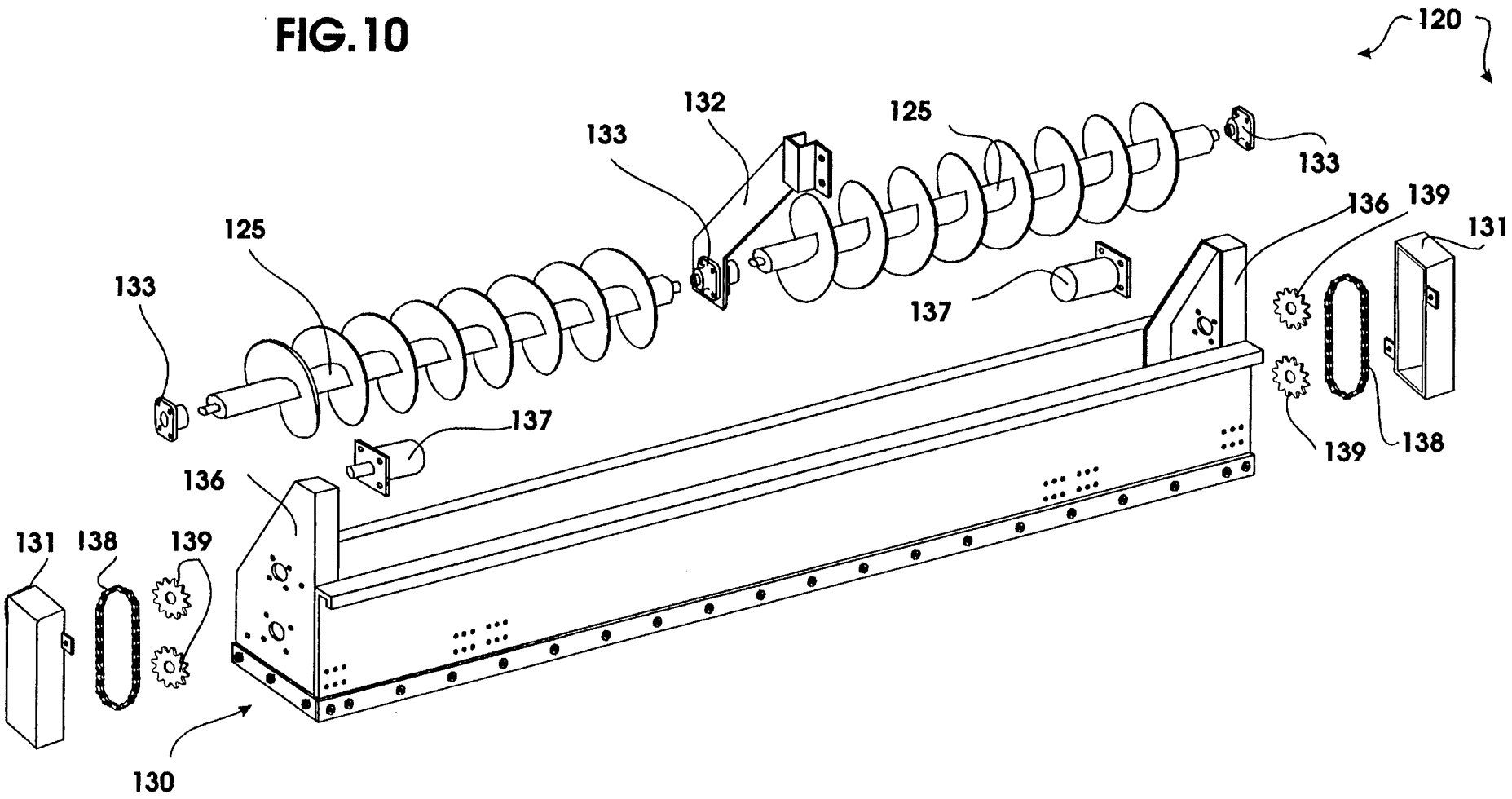
FIG. 10 is an exploded, fragmentary, left rear isometric view of the preferred distribution assembly.

A grid-like reinforcement truss 140, generally in the form of a parallelepiped, structurally braces the finishing assembly 100 (FIGS. 9, 11). In the best mode it comprises separate box portions 143 and 144 secured to opposite ends of a twin-box central section 147. Truss 140 is secured to the back of the distribution boxes 130 and is mounted to the top of the finishing screed 150 via a plurality of spaced-apart vibration dampening grommets 142. Walkways 145 and 146 are secured to the top of the grid and extend from the back of truss 140 over the screed 150 to facilitate hand work, if necessary, of the finished concrete overlay 36 and movement about the paver 30.

The finishing screed 150 (FIGS. 9–11) comprises a forward strike off 155, an intermediate pan 160 and a rear bull float 165. Vibrators 170 are mounted to the pan 160 to facilitate densification and consolidation of the concrete 33 as well as to facilitate finishing the surface. A series of turnbuckles 166 are employed to vary the pitch of the bull float 165 and to facilitate maintaining the elements of the screed 150 in a common plane. The adjustment turnbuckles 166 extend between suitable brackets lip 161 and terminal bevel 163. Additionally, tines 175 are mounted to a boom 177 extending aft from the screed 150. These tines 175 etch a grooved surface into the polymer concrete overlay 36 thereby providing a non slip surface for the roadway. The screed 150 is disposed at a slight positive pitch (FIG. 12) to facilitate compaction of the concrete 33 to ninety-eight to one hundred percent. In other words, the leading edge of the screed 156 is disposed slightly above the trailing edge 167. The overlays 36 made by the present paver 30 generally range from one inch to one and a half inches. Therefore, a positive pitch of one-quarter to one-half inch is enough to extrude the concrete 33 into a contiguous overlay 36 of the necessary density and compaction.

Figure 5:
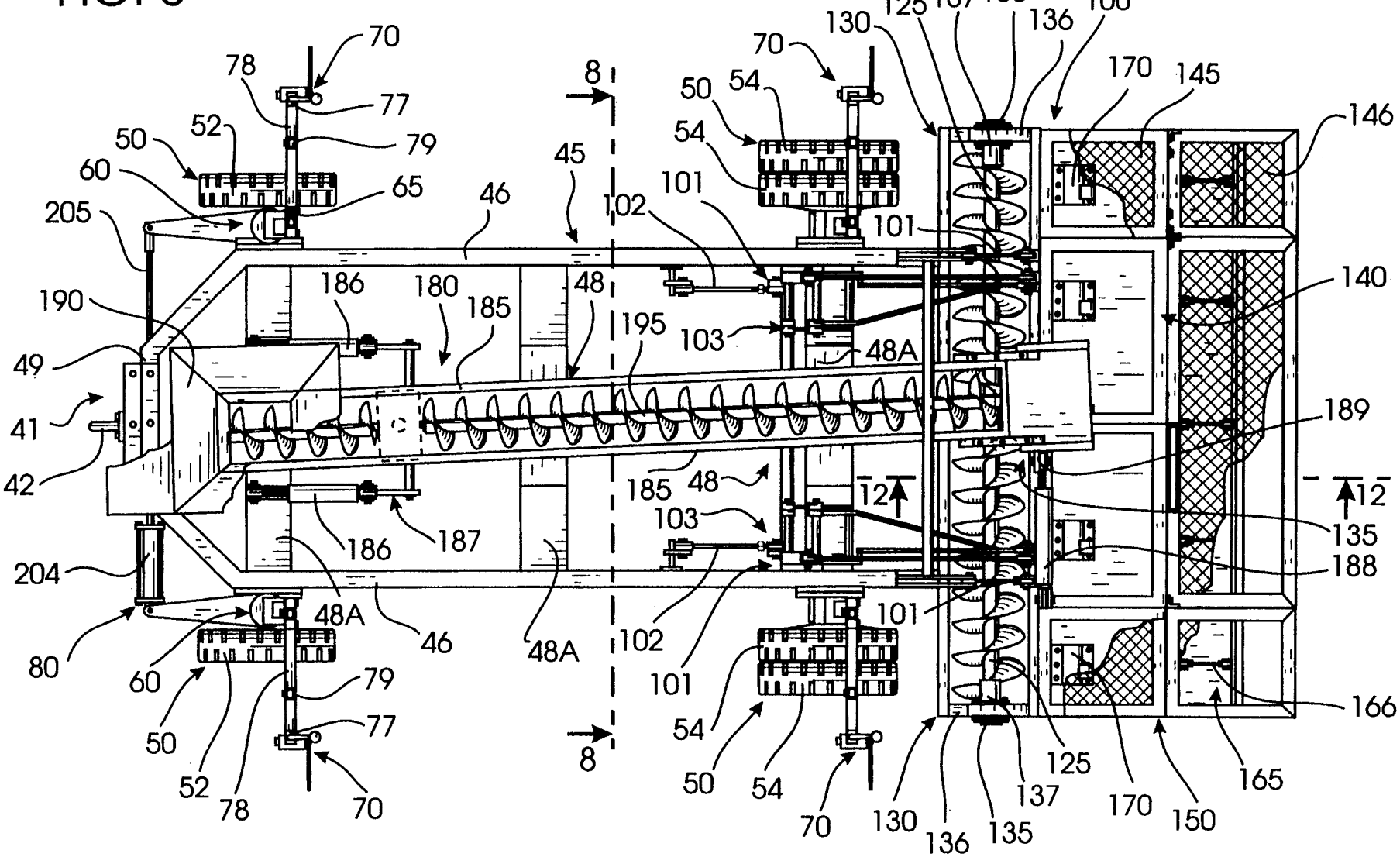
FIG. 5 is a fragmentary, top plan view illustrating the preferred arrangement of the frame, screed and augers with phantom lines showing the trough and lift bracket for the hopper.

The main auger assembly 180, as mentioned above, is disposed along the "belly" of the frame 45 (FIG. 5). The main auger assembly 180 is primarily comprised of a trough 185 extending from the hopper 190 and an auger 195 disposed within the trough 185. Hopper 190 is generally shaped like an inverted, truncated pyramid. The hopper end of the trough 185 is height adjustable by a pair of hydraulic cylinders 186 mounted to the frame 45 which actuate a framework 187 which lifts and lowers the hopper end of the trough 185 to facilitate charging the hopper 190.

The trough 185 extends to the distribution boxes 130, terminating over the input region 135 of the boxes. The trough 185 is slewable from side to side to facilitate filling of the distribution boxes 130 individually or jointly. In other words, the trough 185 can be slewed to fill one distribution box 130 if it is running lower than the other or to provide an even flow into each distribution box 130 when the paver 30 is disposed at an angle. The slew of the trough 185 is controlled by a hydraulic cylinder 188 extending from the reinforcing truss 140 to a bracket 189 on the side of the trough 185.

Figure 2:
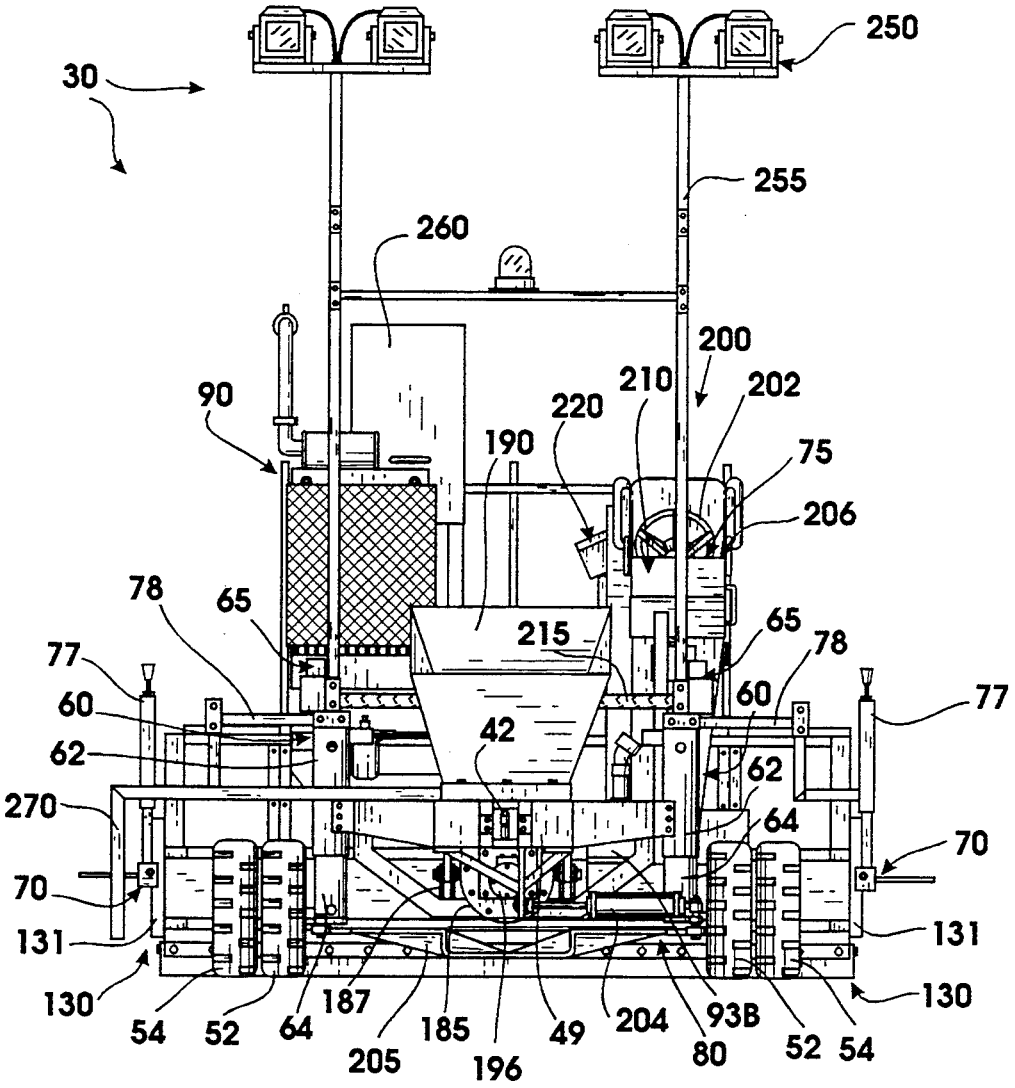
FIG. 2 is a fragmentary, front elevational view of the herein disclosed paver.

The main auger 195 has a bidirectional and variable speed motor 196 (FIG. 2). The main auger 195 moves the polymer concrete 33 from the hopper 190 to the distribution boxes 130 while maintaining a homogeneous blend of the constituent elements of the high slump concrete mixture 33.

Steerage of the front wheels 52 is accomplished through a power steering system 80. The system 80 is controlled by a steering wheel 202 disposed at the driver station 200 and its associated hydraulic circuitry (FIG. 15) as detailed below. The steering linkage is comprised of a hydraulic cylinder 204 controlled by the aforementioned steering wheel 202. One end of this cylinder 204 is secured to the front cross member 49 of the frame 45 and the other is secured to the backing plate of the left front spindle 54 (FIG. 2). A tie rod 205 extends from the left front wheel spindle to the right front spindle 54 to coordinate movement of the front wheels 52.

The optional, automatic steering system 210 is controlled by the string line 35 which also controls the automatic grade control 230. This system senses the string line 35 from side to side and maintains the paver 30 at a distance relative to the string line 35 via the steering hydraulic cylinder 204.

The automatic grade control system 230 as mentioned above is comprised primarily of a control wand 70 disposed at each wheel and electromechanical controls 75 which translate the movement of the wands 70 into control post 60 movement. Each wand 70 controls the extension or retraction of its adjacent post 60. When a wand 70 is displaced a signal is sent to an electrical circuit (FIG. 18) which activates a dithering valve 65 mounted on each post 60. This valve 65 controls which side of the hydraulic cylinder 66 pressure is applied. It is necessary that the control mechanism compensate for the "beam" length of the screed 150 extending behind the vehicle. In other words, since the control wands 70 are remotely located relative to the screed 150 it is necessary to amplify or reduce the amount the movement translated to the posts 60 in order to provide the proper elevation to the finishing screed 150.

Figure 3:
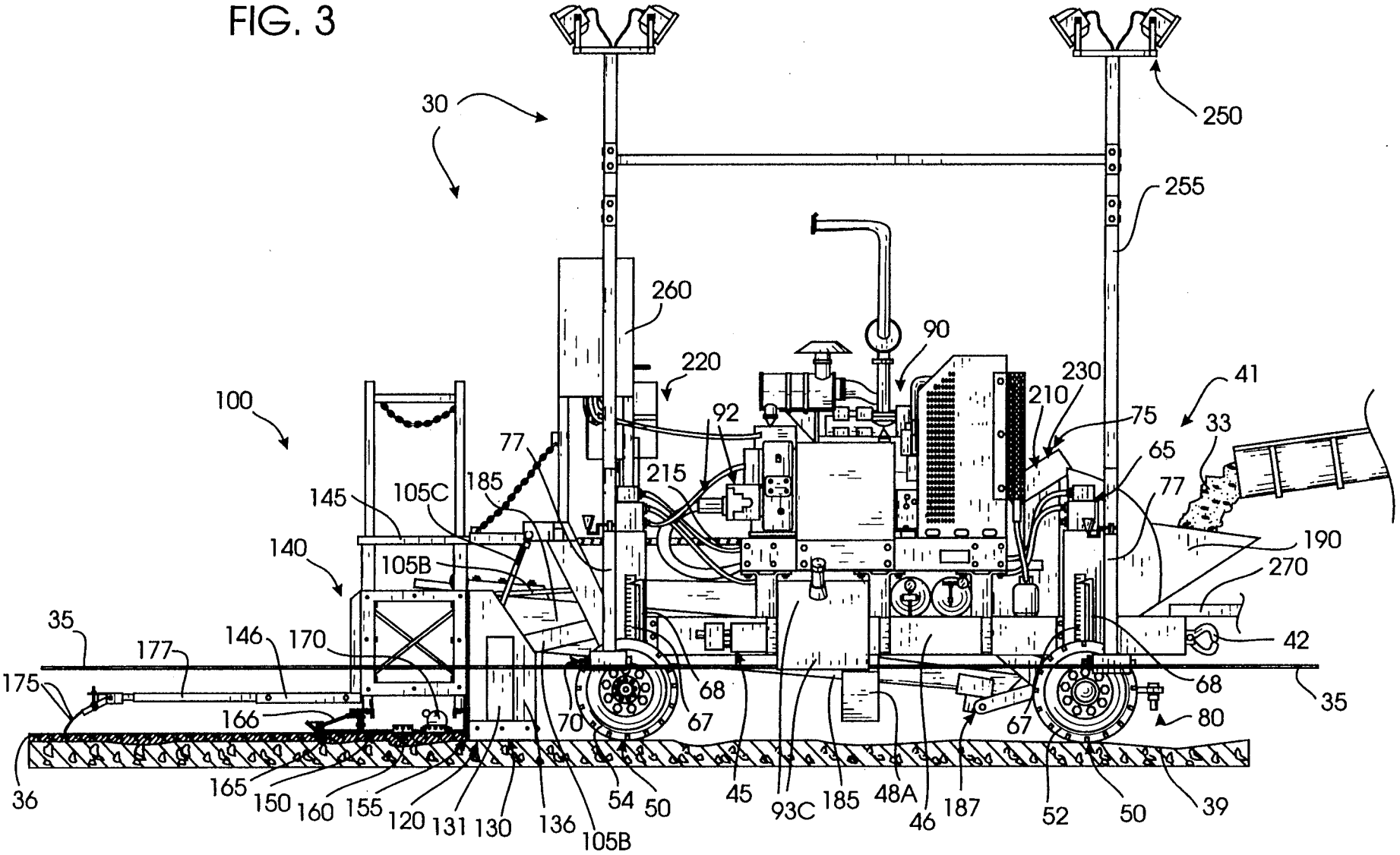
FIG. 3 is a fragmentary, right side, elevational, environmental view of the paver in use, with portions thereof broken away or shown in section for clarity.

The hydraulic pumps 92 powered by the diesel power unit 90 provide hydrostatic and hydraulic pressure for the above mentioned subassemblies. These subassemblies include the automatic grade control system 230, the drive motors 59, the steering systems 80 and 210, lift and slew for the main auger system 180, and the drive for the main and distribution augers 195 and 125 respectively. Fluid is provided to the pumps from several holding tanks 93A, 93B, and 93C (FIGS. 1, 2 and 3 respectively).

Figure 13:
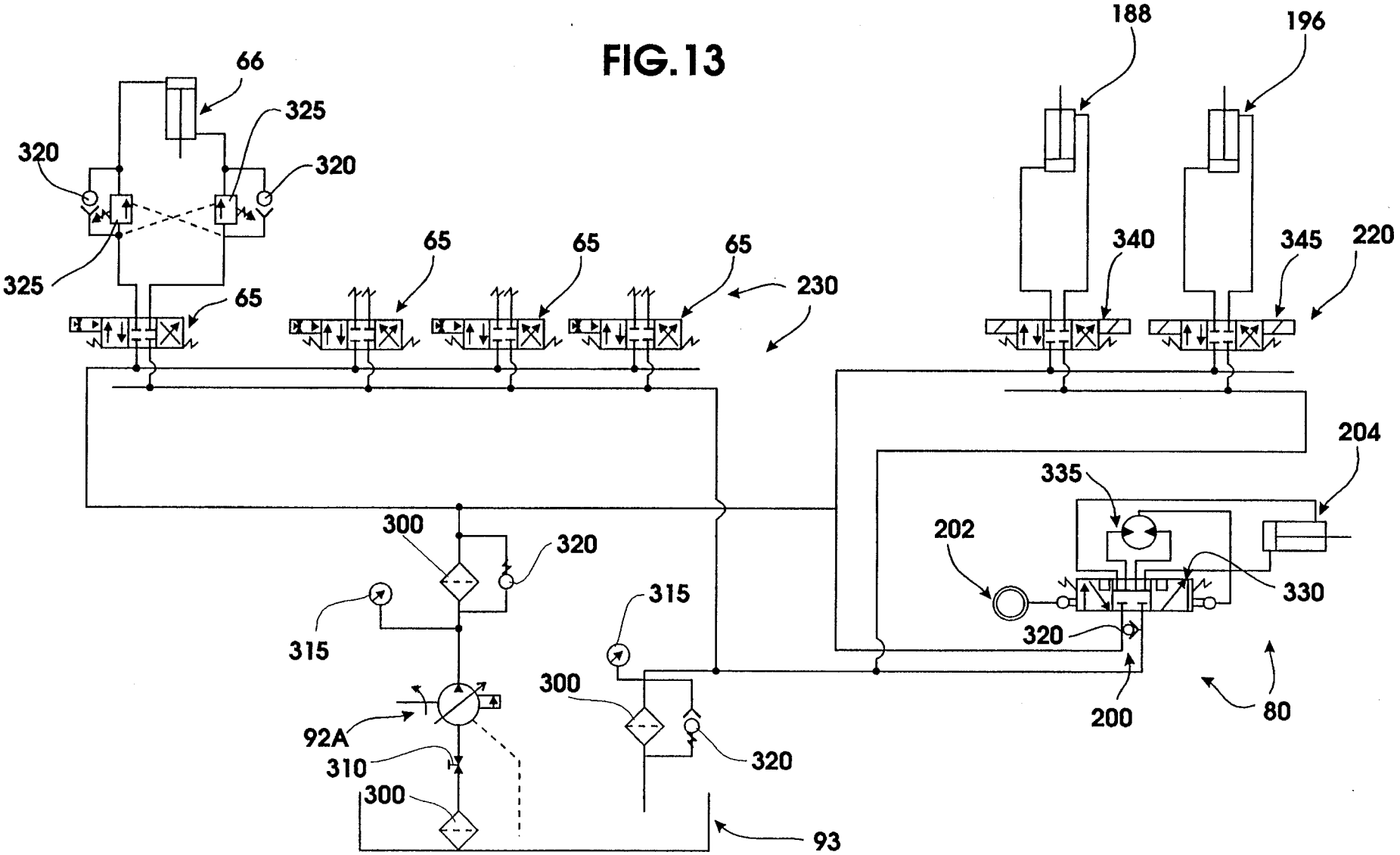
FIG. 13 is a diagrammatic, hydraulic schematic for the paver's post system, power steering, hopper elevation and main auger slew control.
Figure 14:
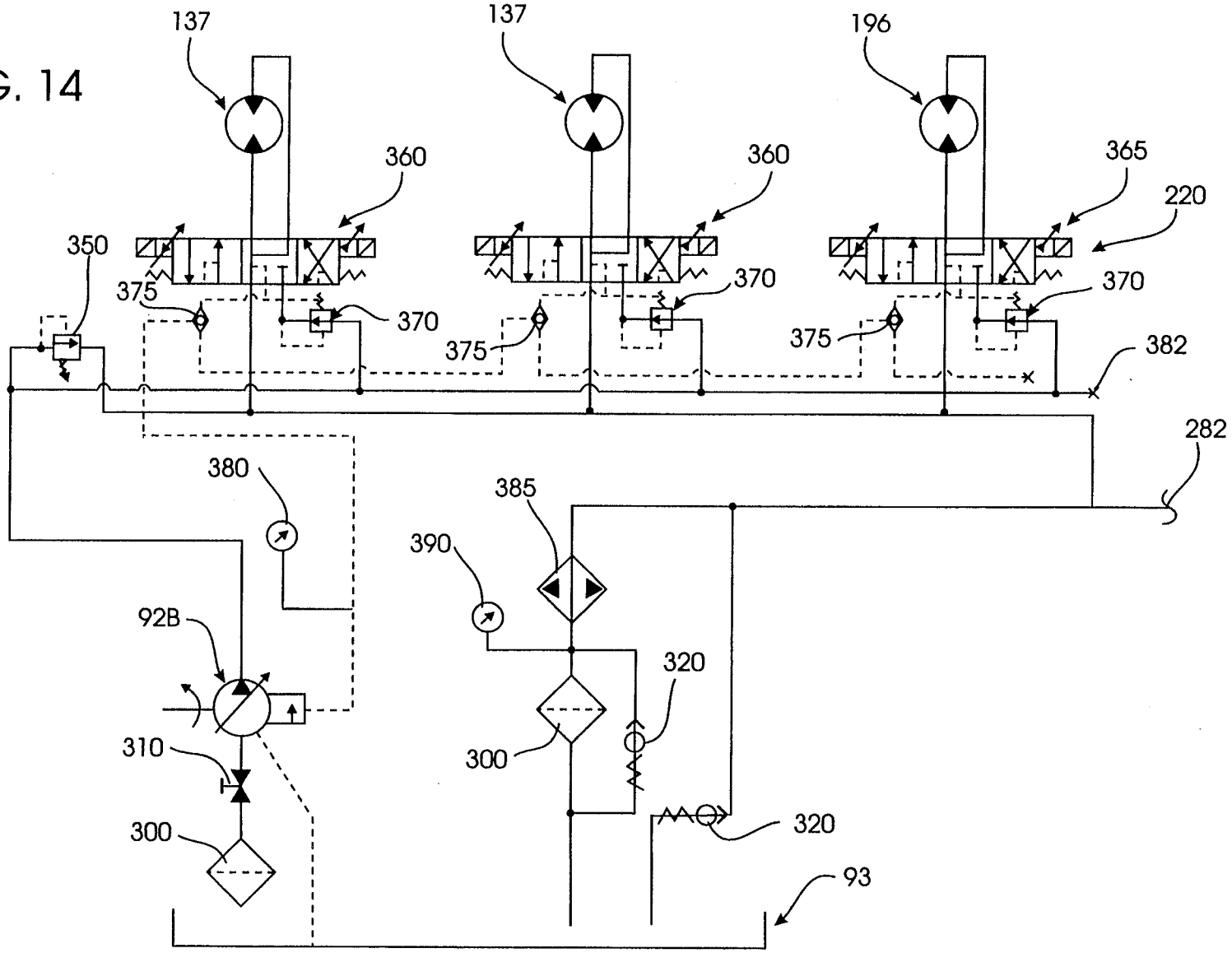
FIG. 14 is a diagrammatic, hydraulic schematic for the speed and direction controls of the paver's augers.
Figure 15:
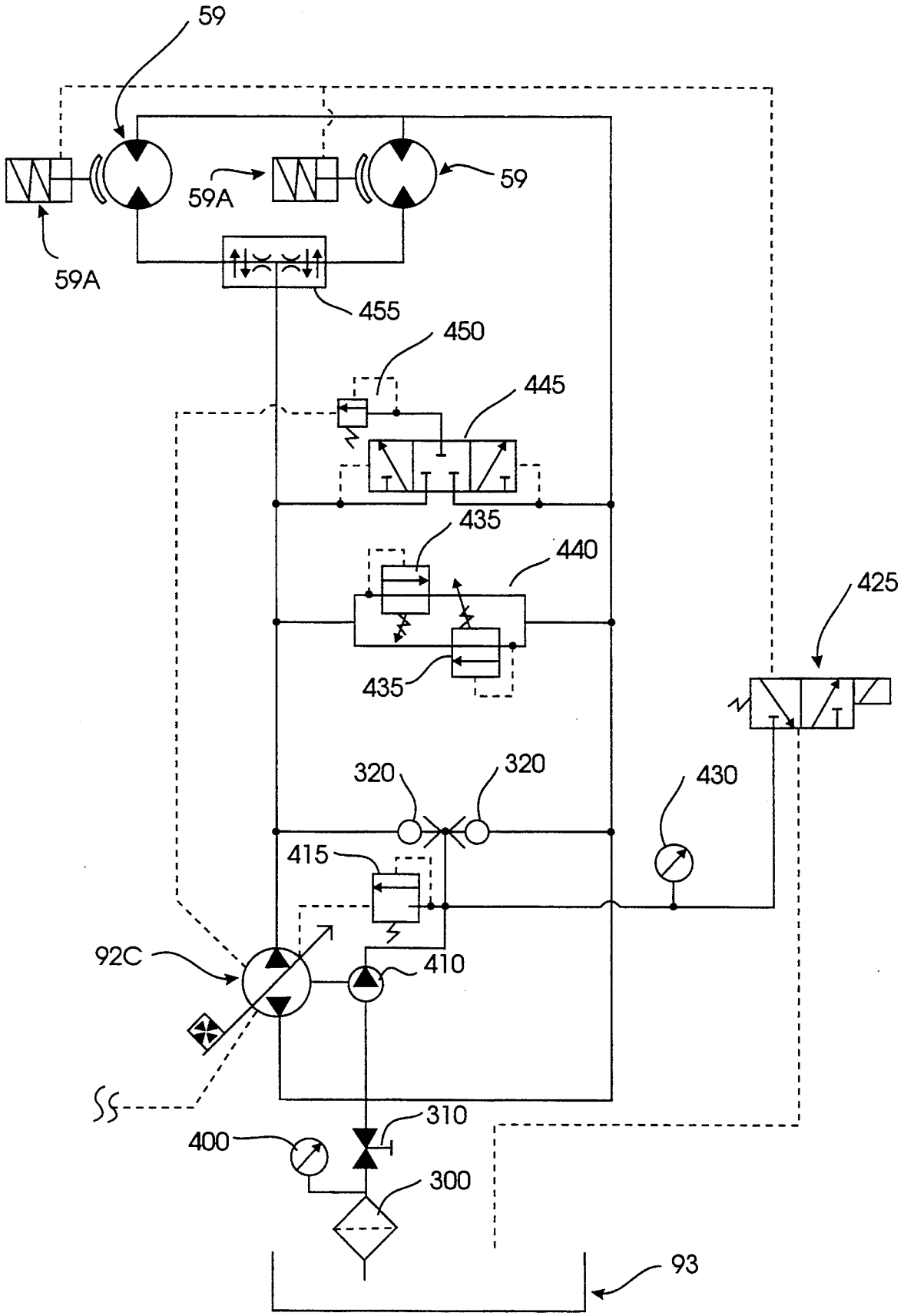
FIG. 15 is a diagrammatic, hydraulic schematic for the paver's hydrostatic drive and its associated controls.

The interrelationship of the hydraulic components of the paver 30 are illustrated in detail in FIGS. 13, 14 and 15. The hydraulic fluid storage tanks are designated by the numeral 93, pick up screens and other filters are designated by the reference numeral 300. Shutoff valves are labeled 310 and check valves 320.

Pump 92A (FIG. 13) powers the automatic grade control system 230, steering system 80, the slew of the trough 185 and the elevation of the hopper 190. It draws fluid from one of the hydraulic storage tanks 93 via a pickup screen 300 and a shut off valve 310. Its output is monitored by a pressure gauge 315 disposed at the drivers station 200. The output is filtered by a second filter 300 which employs a check valve 320. Fluid return from the aforementioned hydraulic systems is returned to the fluid tank 93 via filter 300 and a check valve 320. The check valves 320 maintain fluid in the system upon shutdown.

Figure 16:
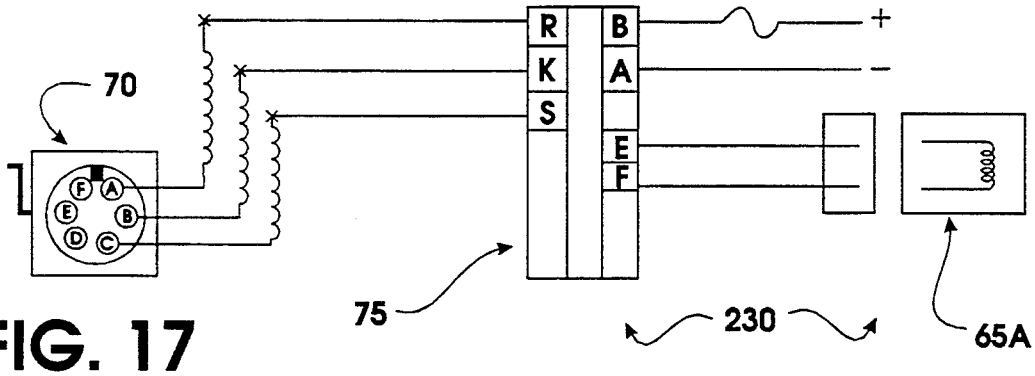
FIG. 16 is a diagrammatic, electrical schematic of the paver's grade sensing and control system.

The automatic grade control system 230 (FIG. 13) employs the pressure produced by pump 92A to control the extension and retraction of the hydraulic post cylinders 66. The pressure input for each cylinder 66 is controlled by a servo-dithering valve 65. The valve 65 receives electrical input from the wands 70 this input directs the valve 65 to open or close the hydraulic circuit to each side of its hydraulic cylinder 66 via a relay 65A (FIG. 16) contained in the servo-dithering valve 65. The pressure output to either side of the cylinder 66 passes through a pressure relief valve 325 and check valve 320 circuit. This circuit enables the cylinders 66 to maintain fluid when the system 230 is inoperative or at idle.

The steering system 80 employs the pressure produced by pump 92A as well (FIG. 13). The supply line for the steering system 80 is interconnected with the return line for the system by a check valve 320. The steering wheel 202 at the drivers station 200 controls a steering valve 330 interconnected with a proportional steering valve 335. The pressure output by the steering valve 330 controls the extension and retraction of the steering cylinder 204 which deflects the front wheels 52 as detailed above.

The extension and retraction of the slew and hopper lift cylinders 188 and 186, respectively, are each controlled by a valve 340 and 345, respectively, disposed at the operators station 220. As with the immediately preceding systems 230 and 80 hydraulic pressure is provided to these systems by pump 92A.

As detailed in FIG. 14 hydraulic pump 92B draws hydraulic fluid from one of the hydraulic tanks 93 via a screen 300 and a shut off valve 310. Its pressure is employed to drive the main and distribution augers 195 and 125. The output of the pump 92B passes through a control valve 360 or 365 for each of the auger drive motors 137 or 196, respectively. A controlled relief valve 350 is connected in parallel with the controls and motors. Additionally, each control valve 360 or 370 has an associated relief valve 370 to vent excess pressure to the return side of the circuit. A "T" check valve 375 directs the return from each of the control valves 360 or 365 through a pressure gauge 380 to the pump 92B. Pressure from the circuit powered by pump 92B also provides incidental hydraulic pressure where it may be needed 382, particularly to the hydrostatic pump 92C (FIG. 15). Return fluid from the circuit passes through a heat exchanger 385, is monitored by a pressure gauge 390 and is returned to the Tank 93 via a filter 300 which employs a check valve 320.

The drive wheels 54 are driven by a larger hydrostatic pump 92C (FIG. 15). As with the other pumps it draws fluid from a tank 93 via a pick up screen 300. A pressure gauge 400 reads the pressure drawn by the pump. A shut off valve is disposed between the valve 310 and a charging pump 410. The charging pump 410 is used to initiate and maintain pressure in the hydrostatic pump 92C. A pressure relief valve 415 and a pair of check valves 320 insure that the output of the charging pump is properly directed. The charging pump as well as the hydrostatic pump provides hydraulic pressure for the paver's brakes 59A. The brakes 59A are controlled by a three way valve 425. Pressure supplied to the brake system is monitored by a gauge 430. The output of the hydrostatic pump 92C is provided to the drive motors 59 via a circuit which has a pair of relief valves 435, themselves connected in parallel to establish a cross relief valve system 440. A flushing valve 445 provides control over fluid flow to the motors 59. A relief valve 450 is employed by the flushing valve 445 to direct excess pressure back to the hydrostatic pump 92C. Pressure provided to the motors 59 is evenly distributed to each motor 59 through divider valve 455.

Figure 17:
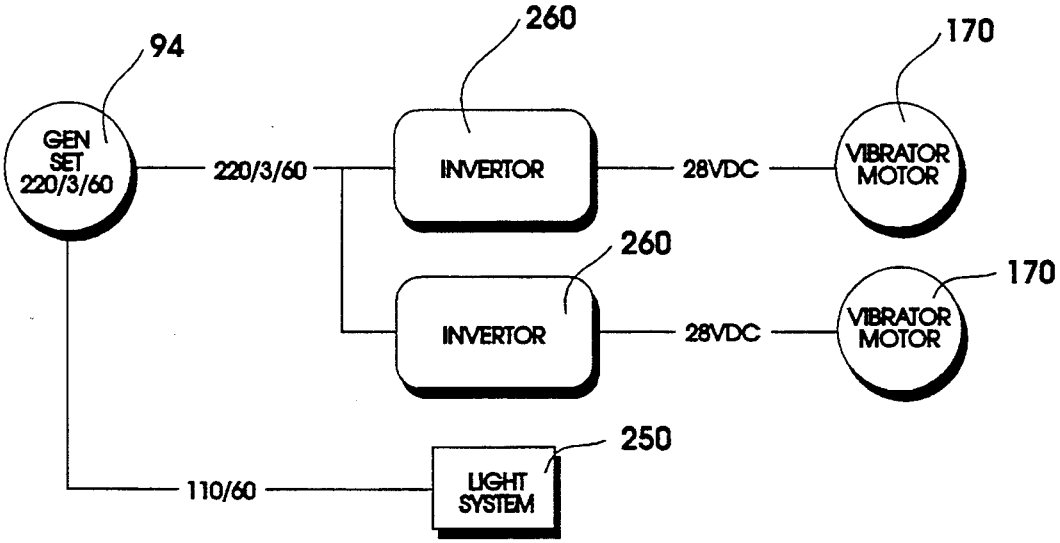
FIG. 17 is a diagrammatic, block illustration of the electrical system of the paver powered by the belt driven two hundred twenty volt generator; and, FIG. 18 is a diagrammatic, block illustration of the electrical system of the paver powered by the belt driven twelve volt, direct current alternator.
Figure 18:
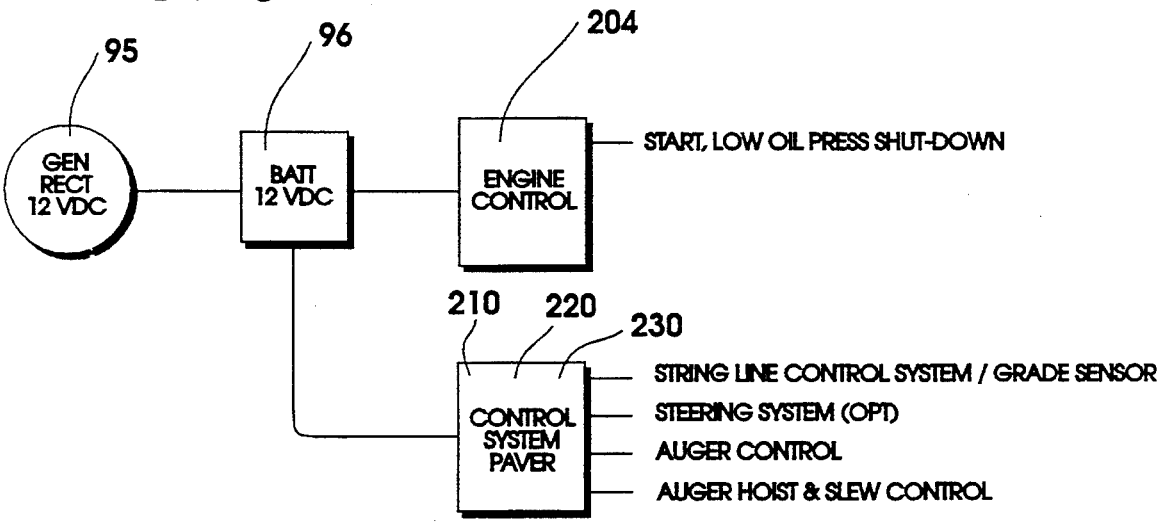

Turning to FIGS. 17 and 18 the electrical generators 94 and 95 powered by the diesel unit 90 include a two hundred thirty volt alternating current, three wire, sixty cycle generator 94 as well as a conventional twelve volt alternator 95. The twelve volt alternator provides power to the conventional operating systems of the diesel motor such as start and stop controls and monitoring systems 207 housed at the driver's station 200 as well as a conventional twelve volt battery 96. The two hundred thirty volt generator provides one hundred-ten and two hundred-thirty volt AC current for use by conventional hand tools. It also provides current for a lighting system 250 which is disposed upon masts 255 extending from the frame 45 of the vehicle 30 upwards to a height appropriate to light night paving operations. Additionally, the current from the AC generator 94 is rectified and filtered by voltage inverters 260. The resulting twenty-eight volts direct current is used to power the vibrators 170 disposed on the finishing assembly 100. A compressed air system utilizes the diesel power unit's air compressor output for pneumatic tools employed during and in preparation of paving operations.

Operation

The steps to setup the polymer paver 30 vary from application to application. The order of the steps vary from job site to job site depending on the situations encountered due to the interrelated nature of the steps involved in setup. First the string lines 35 are established according to the specifications for a particular job. Grade hubs established by the survey crew establish proper setting to establish elevation. Hubs usually are placed three or four feet behind the concrete along the length of the project. Behind each hub is a flat stake marked by the survey crew to provide proper alignment. The string line 35 should be straight and tight.

Generally the overlay 36 to be deposited is between three quarters and one and one half inches thick. The overlay 36 is laid over a prepared road surface 39. The string lines 35 are strung to reflect the profile desired of the finished concrete overlay 36. Manual control jacks 77 are fitted to the paver 30 to adjust the height of the control wands 70 (FIGS. 1–5). The jacks 77 are used to set the control wands 70 to the proper height to contact the string line 35. If the thickness of the overlay 36 deposited by the paver 30 is not sufficient or is uneven from side to side, the manual screw jacks 77 can be employed to correct the situation. The control wands 70 may be jacked downward thereby extending the associated posts 60 to increase the thickness or to change the dimensions of the overlay 36. The control wands 70 and jacks 77 are mounted on a laterally sliding framework 78 (FIG. 2) with lock screws as it is often necessary to set up the string line 35 at varying distances from the lane to be paved. Each post 60 has a reference scale 67 associated with it (FIGS. 1 and 3). The upper post 60 has a reference scale 67 affixed to it while the lower post 60 or wheel mount area has a fixed pointer 68 which extends up to the reference scale 67. Therefore, the height of all four posts 60 can be centered and referenced to one another.

In other words, to allow maximum travel both up and down for each wheel 50 each post 60 can be extended to a point approximately midway its total travel. Additionally, by noting the reference scale 67 readings during initial setup, evaluation of the pavers performance can be made throughout the placement. Once the control wands 70 and the control posts 60 are initially set the automatic grade control system 230 can be powered up and set to null. In other words, with the wands 70 and posts 60 set up the grade control system 230 will be reset to zero to indicate that the screed 150 is at the relative orientation that is needed throughout the placement. Therefore, when a wand 70 is displaced by its associated wheel 50 contacting a grade change it will send a signal to an amplifier within the electromechanical controls 75. The direction of the correction necessary is communicated to the dithering valve 65 for the associated post 60. As a result hydraulic pressure is applied to the associated post cylinder 66. As a result the screed is repositioned relative to the plane 47 of the frame 45 to maintain the desired grade. Consequently, the control wand 70 is repositioned until it reaches the null position.

The hopper 190 receives plastic, premixed polymer concrete 33 from a mixer truck traveling in front of the polymer paver 30. The main auger 180 is used to convey it aft to the distribution boxes 130. The trough 185 is moved from side to side to maintain equal levels of concrete 33 in each distribution box 130. The concrete 33 is broadcast laterally by the distribution augers 125. As the paver 30 moves forward the concrete 33 in the distribution boxes 130 is processed by the screed 150 assembly. In effect, the positive pitch of the screed 150 facilitates extrusion of the concrete 33. The concrete 33 is "squeezed" by the screed 150 as well as vibrated and finished thereby eliminating virtually all entrained air pockets.

Control of the polymer paver 30 is carried out by two operators, a driver and a paving operator. Each of these individuals has a control station 200 and 220 on the vehicle. The driver's station 200 is disposed toward the front of the paver 30. As illustrated in FIGS. 1 and 2 it is disposed to one side of the hopper 190 and houses a steering wheel 202 to control the front wheels 52 of the paver 30 as well as two control panels 206 and 207. The forward panel 206 controls the speed and direction of the vehicle 30, the automatic grade control system 230, and an optional automatic steering system 210. The other control panel 207 operates the general circuits involved with the diesel power unit 90. The automatic grade control system 230 employs an electromechanical system 75 to control the hydraulic pressure flow to the posts 60 in response to input from the control wands 70.

A steering gage 270 is disposed on the front of the paver 30 (FIG. 2). This gage is an extensible metal "L" shaped bar which extends to a position relatively close to the ground. The driver can use it as a "sight" to determine corrections in the pavers path. The driver can use this steering gauge 270 to maintain proper alignment of the overlay placement, particularly relative to previously placed overlays 36 or roadway edges. Alternatively, the aforementioned string line 35 sensing, automatic steering 210 may be employed to ensure proper overlay placement.

A walkway 215 extends from the driver's station 200 rearward to the operator's station 220. This walkway is removable to allow access to the main auger 195 and trough 185 to facilitate cleaning and maintenance.

The operator's station 220 is disposed on the aft portion of the chassis 40 adjacent the distribution boxes 130 (FIG. 1). The operator controls the slew of the trough 185 as well as the elevation of the hopper 190. Additional controls vary the speeds of each of the three augers 125 and 195 and their direction. Also under the operators control are the electric vibrators 170 disposed on the screed 150.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A paver for applying polymer concrete to a surface to be paved, said paver comprising:

a mobile chassis adapted to move over said surface to be paved, said chassis comprising:

a rigid, supporting frame having a pair of sides, said frame establishing a plane;

a plurality of wheels for supporting said frame; and, active suspension means for coupling said wheels to said frame;

grade control means for sensing changes in grade as the chassis moves over said surface, said grade control means comprising means for extending or contracting said suspension means to orient said plane generally parallel to said surface to be paved;

a finishing assembly secured to said chassis for distributing and finishing polymer concrete, said finishing assembly comprising:

distribution means for spreading concrete over said surface; and, a finishing screed disposed adjacent said distribution means for densifying and finishing said concrete;

means for receiving raw concrete from an external source and conveying it to said finishing assembly;

steering sensing means for automatically steering said chassis;

means for referencing an intended resultant plane that is established by the repaired surface; and, logic means responsive to said means for referencing said intended resultant plane for activating said grade control means for extending or contracting said suspension means thereby variably orienting the plane of said frame with said intended resultant plane.

2. The paver as defined in claim 1 wherein said suspension means comprises:

a back plate attached to each of said wheels;

a lower sleeve affixed to said back plate;

an upper sleeve affixed to said frame and telescoped to said lower sleeve; and, internal cylinder means coaxial with said upper and lower sleeves for contracting or extending them relative to each other.

3. The paver as defined in claim 2 further comprising electromechanical means responsive to said means for referencing for activating said cylinder means for extending or contracting said suspension means thereby variably orienting said chassis.

4. The paver as defined in claim 1 wherein said distribution means comprises:

an elongated distribution box having a generally rectangular cross-section defined between front and back walls and an open top and open bottom, said box comprising an input region adapted to receive concrete and a pair of ends spaced from said input region; and, bidirectional, distribution auger means deployed within said distribution box for moving concrete from said input region between said ends upon said surface to be paved.

5. The paver as defined in claim 4 wherein said finishing screed comprises:

a strike off comprising a forward edge of said screed;

a bull float comprising a trailing portion of said screed;

an intermediate pan extending between said strike off and said bull float; and, means for vibrating said screed to aid in finishing and densifying said concrete.

6. The paver as defined in claim 5 wherein said screed is disposed with the strike off at a higher relative elevation than the bull float thereby establishing a positive pitch to facilitate densification and consolidation of the concrete.

7. The paver as defined in claim 1 wherein said means for receiving raw concrete and conveying it to said finishing assembly comprises:

vertically displaceable hopper means for receiving said concrete;

trough means extending from said hopper means for conducting concrete to said finishing assembly; and, auger means for moving said concrete through said trough.

8. The paver as defined in claim 7 wherein:

said trough means extends from said hopper means to said distribution means, said trough means generally centered on said frame, with a rear end thereof disposed in slewable communication with said distribution means; and, said auger means comprises a bidirectional, variable speed auger for moving said concrete through said trough and maintaining consolidation of the constituent components of said concrete.

9. A polymer paver comprising:

a mobile chassis adapted to move over a surface to be paved, said chassis comprising:

a rigid, supporting frame having a pair of sides establishing a plane;

a plurality of wheels for supporting said frame; and, dynamically extensible post means for adjustably suspending said wheels to said frame; and, grade control means for sensing changes in grade as the chassis moves over the surface to be paved and controlling said post means, said grade control means comprising means for extending or contracting said post means to orient said plane generally parallel to said surface;

a finishing assembly secured to said chassis for distributing and finishing concrete, said finishing assembly comprising distribution means for spreading concrete over said surface and finishing means for densifying and finishing said concrete;

hopper means for receiving raw concrete and conveying it to said finishing assembly;

means for referencing an intended resultant plane to be established by said surface to be paved; and, logic means responsive to said means for referencing for activating said grade control means for extending or contracting said post means thereby variably orienting said frame plane with said intended resultant plane.

10. The paver as defined in claim 9 wherein said dynamically extensible post means comprises:

a back plate attached to each of said wheels;

a lower sleeve affixed to said back plate;

an upper sleeve telescoped to said lower sleeve and affixed to said frame;

internal cylinder means coaxially disposed within said upper and lower sleeves for displacing them from each other for extending or contracting said post means.

11. The paver as defined in claim 9 wherein said distribution means comprises:

an elongated distribution box having a generally rectangular cross-section defined between front and back walls and an open top and open bottom, said box comprising an input region adapted to receive concrete from said hopper means and a pair of ends spaced from said input region; and, auger means deployed within said distribution box for moving concrete from said input region between said ends upon said surface to be paved.

12. The paver as defined in claim 11 wherein said finishing screed means comprises:

a strike off comprising a forward edge;

a bull float comprising a trailing portion thereof;

an intermediate pan extending between said strike off and said bull float; and, vibrator means for vibrating said screed to aid in finishing and densifying said concrete.

13. The paver as defined in claim 12 wherein said screed means is disposed with the strike off at a higher relative elevation than the bull float, thereby establishing a positive pitch to facilitate densification and consolidation of the concrete.

14. The paver as defined in claim 13 wherein said hopper means is vertically adjustable and comprises trough means extending from said hopper means for conducting concrete to said finishing assembly and auger means for moving said concrete through said trough.

15. The polymer paver as defined in claim 14 wherein:

said trough means extends from said hopper means to said distribution means, and said trough means generally centered on said frame with a rear end thereof disposed in slewable communication with said distribution means; and, said auger means comprises a bidirectional, variable speed auger for maintaining consolidation of the constituent components of said concrete.

16. The paver as defined in claim 15 wherein said dynamically extensible post means comprises:

a lower sleeve affixed to each wheel;

an upper sleeve telescoped to said lower sleeve affixed to said frame;

internal cylinder means coaxially disposed within said upper and lower sleeves for displacing them from each other for extending or contracting said post means.

17. The paver as defined in claim 16 wherein said distribution means comprises:

an elongated distribution box having a generally rectangular cross-section defined between front and back walls and an open top and open bottom, said box comprising an input region adapted to receive concrete and a pair of ends spaced from said input region; and, bidirectional, distribution auger means deployed within said distribution box for moving concrete from said input region between said ends upon said surface to be paved.

18. The paver as defined in claim 17 wherein said finishing screed means comprises:

a strike off comprising a forward edge;

a bull float comprising a trailing portion thereof;

an intermediate pan extending between said strike off and said bull float;

vibrator means for vibrating said screed to aid in finishing and densifying said concrete; and, said screed means is disposed with the strike off at a higher relative elevation than the bull float, establishing a positive pitch, to facilitate densification and consolidation of the concrete.

19. A concrete paver adapted to convey high slump concrete from a mixer truck, distribute it to a prepared roadway surface and finish it to a relatively thin overlay that establishes an intended resultant plane, said paver comprising:

a mobile chassis adapted to move over an elongated, irregularly tilted surface to be paved in a user selected direction of travel, said chassis comprising:

a rigid frame having a pair of sides, said frame establishing a frame plane;

a plurality of wheels for supporting said chassis;

means for rotating said wheels;

active suspension means for coupling said wheels to said frame, said suspension means comprising a lower sleeve operatively coupled to each wheel, an upper sleeve affixed to said frame and telescoped to said lower sleeve, and internal cylinder means coaxial with said upper and lower sleeves for contracting or extending them relative to each other;

grade control means for sensing changes in grade as the chassis moves over the tilted surface to be paved, said grade control means comprising means for extending or contracting said suspension means to orient said plane generally parallel to said surface;

displaceable hopper means secured to said chassis for initially receiving concrete to be applied;

a concrete finishing assembly for distributing and finishing said high slump concrete upon a surface to be paved, said finishing assembly comprising:

distribution means for laterally, adjustably spreading concrete, said distribution means oriented transversely with respect to said direction of travel for distributing concrete upon said surface to be paved;

an elongated finishing screed operatively disposed adjacent said distribution means for densifying and finishing said concrete, said finishing screed comprising vibrator means for vibrating said screed to aid in finishing and densifying said concrete;

a reinforcing grid generally in the form of a parallelepiped for structurally bracing said finishing assembly, said grid disposed upon said screed and secured to said distribution means; and, trough means extending from said hopper means for conducting concrete to said finishing assembly, said trough means generally centered on said frame, with a rear end thereof disposed in slewable communication with said distribution means.

20. The paver as defined in claim 9 wherein said grade control means comprises:

means for referencing an intended resultant plane of the surface to be paved; and, logic means responsive to said means for referencing for activating said suspension means for extending or contracting said cylinder means thereby variably orienting said chassis to properly align said finishing assembly to said surface to be paved.

21. The paver as defined in claim 20 including dampening means for isolating screed vibrations from said reinforcing grid.

22. The paver as defined in claim 20 wherein said distribution means comprises a generally rectangular cross-section defined between front and back walls, a pair of spaced apart ends and an open top and open bottom, an input region for receiving concrete from said trough means, and distribution auger means for moving concrete from said input region between said ends upon said surface to be paved.

23. The paver as defined in claim 20 wherein said finishing screed comprises:

a strike off comprising a forward edge of said screed;

a bull float comprising a trailing portion of said screed; and, an intermediate pan extending between said strike off and said bull float.

24. The paver as defined in claim 23 wherein said finishing screed is disposed with the strike off at a higher relative elevation than the bull float thereby establishing a positive pitch to facilitate densification and consolidation of the concrete.

25. The paver as defined in claim 20 wherein said trough means comprises a bidirectional, variable speed auger for moving concrete through said trough means and maintaining consolidation of the constituent components of said concrete.

26. A concrete finishing assembly for distributing and finishing high slump concrete upon a surface to be paved, said assembly comprising:

means for referencing an intended resultant plane;

distribution means for laterally, adjustably spreading concrete, said distribution means comprising:

an elongated distribution box having a generally rectangular cross-section defined between front and back walls and an open top and open bottom, said box comprising an input region adapted to receive concrete and a pair of ends spaced from said input region;

bidirectional, distribution auger means deployed within said distribution box for moving concrete from said input region between said ends upon said surface to be paved;

an elongated finishing screed rigidly disposed adjacent said distribution box for densifying and finishing said concrete, said finishing screed comprising:

a strike off comprising a forward edge of said screed;

a bull float comprising the trailing portion of said screed; and, an intermediate pan extending between said strike off and said bull float; and, vibrator means affixed to said screed for vibrating said screed to aid in finishing and densifying said concrete; and, wherein said screed is disposed with the strike off at a higher relative elevation than the bull float, thereby establishing a positive pitch to facilitate densification and consolidation of the concrete.

27. A concrete finishing assembly for distributing and finishing high slump polymer concrete upon a surface to be paved, said assembly comprising:

means for referencing an intended resultant plane;

distribution means for laterally, adjustably spreading concrete, said distribution means comprising:

an elongated distribution box having a generally rectangular cross-section defined between front and back walls and an open top and open bottom, said box comprising an input region adapted to receive concrete and a pair of ends spaced from said input region;

bidirectional, distribution auger means deployed within said distribution box for moving concrete from said input region between said ends upon said surface to be paved;

an elongated finishing screed rigidly disposed adjacent said distribution box for densifying and finishing said concrete, said finishing screed comprising vibrator means for vibrating said screed to aid in finishing and densifying said concrete;

a reinforcing grid generally in the form of a parallelepiped for structurally bracing the assembly, said grid disposed upon said screed and secured to said distribution box; and, dampening means for isolating screed vibrations from said grid assembly.

* * * * *